US009284817B2

(12) United States Patent
Walton et al.

(10) Patent No.: US 9,284,817 B2
(45) Date of Patent: Mar. 15, 2016

(54) DUAL MAGNETIC SENSOR ACTUATION ASSEMBLY

(71) Applicant: Halliburton Energy Services, Inc., Houston, TX (US)

(72) Inventors: Zachary W. Walton, Duncan, OK (US); Matthew T. Howell, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 395 days.

(21) Appl. No.: 13/828,824

(22) Filed: Mar. 14, 2013

(65) Prior Publication Data

US 2014/0262234 A1 Sep. 18, 2014

(51) Int. Cl.

| | |
|---|---|
| ***E21B 34/14*** | (2006.01) |
| ***E21B 34/06*** | (2006.01) |
| ***E21B 34/10*** | (2006.01) |

(52) U.S. Cl.

CPC ..... *E21B 34/14* (2013.01); *E21B 34/06* (2013.01); *E21B 34/102* (2013.01); *E21B 34/103* (2013.01)

(58) Field of Classification Search

CPC ..... E21B 47/0905; E21B 47/00; E21B 34/00; E21B 2034/007; E21B 34/06; E21B 34/066; E21B 34/103; E21B 34/102

See application file for complete search history.

(56) References Cited

U.S. PATENT DOCUMENTS

| | | | |
|---|---|---|---|
| 2,076,308 | A | 4/1937 | Wells |
| 2,189,936 | A | 2/1940 | Brandfon |
| 2,189,937 | A | 2/1940 | Broyles |
| 2,308,004 | A | 1/1943 | Hart |
| 2,330,265 | A | 9/1943 | Burt |
| 2,373,006 | A | 4/1945 | Baker |
| 2,381,929 | A | 8/1945 | Schlumberger |
| 2,618,340 | A | 11/1952 | Lynd |
| 2,618,343 | A | 11/1952 | Conrad |

(Continued)

FOREIGN PATENT DOCUMENTS

| | | | |
|---|---|---|---|
| EP | 2372080 | A2 | 10/2011 |
| WO | 9925070 | A2 | 5/1999 |

(Continued)

OTHER PUBLICATIONS

Danaher product information, Motion Brakes, http://www.danahermotion.com/website/usa/eng/products/clutches_and_brakes/115836.php, Mar. 4, 2009, 3 pages, Danaher Motion.

(Continued)

*Primary Examiner* — Brad Harcourt

(74) *Attorney, Agent, or Firm* — John W. Wustenberg; Baker Botts L.L.P.

(57) ABSTRACT

A well tool comprising a housing comprising ports and defining a flow passage, an actuator, a dual magnetic sensor actuation assembly (DMSAA) in signal communication with the actuator and comprising a first magnetic sensor up-hole relative to a second magnetic sensor, and an electronic circuit comprising a counter, and wherein, the DMSAA detects a magnetic signal and determines the direction of movement of the magnetic device emitting the magnetic signal, and a sleeve slidable within the housing and transitional from a first position in which the sleeve prevents fluid communication via the ports to a second position in which the sleeve allows fluid communication via the ports, wherein, the sleeve transitions from the first to the second position upon recognition of a predetermined quantity of magnetic signals traveling in a particular direction.

21 Claims, 20 Drawing Sheets

(56) References Cited

U.S. PATENT DOCUMENTS

| | | | |
|---|---|---|---|
| 2,637,402 | A | 5/1953 | Baker et al. |
| 2,640,547 | A | 6/1953 | Baker et al. |
| 2,695,064 | A | 11/1954 | Ragan et al. |
| 2,715,444 | A | 8/1955 | Fewel |
| 2,871,946 | A | 2/1959 | Bigelow |
| 2,918,125 | A | 12/1959 | Sweetman |
| 2,961,045 | A | 11/1960 | Stogner et al. |
| 2,974,727 | A | 3/1961 | Goodwin |
| 3,029,873 | A | 4/1962 | Hanes |
| 3,055,430 | A | 9/1962 | Campbell |
| 3,122,728 | A | 2/1964 | Lindberg, Jr. |
| 3,160,209 | A | 12/1964 | Bonner |
| 3,195,637 | A | 7/1965 | Wayte |
| RE25,846 | E | 8/1965 | Campbell |
| 3,217,804 | A | 11/1965 | Peter |
| 3,233,674 | A | 2/1966 | Leutwyler |
| 3,266,575 | A | 8/1966 | Owen |
| 3,398,803 | A | 8/1968 | Leutwyler et al. |
| 3,556,211 | A | 1/1971 | Bohn et al. |
| 3,659,648 | A | 5/1972 | Cobbs |
| 4,085,590 | A | 4/1978 | Powell et al. |
| 4,282,931 | A | 8/1981 | Golben |
| 4,352,397 | A | 10/1982 | Christopher |
| 4,377,209 | A | 3/1983 | Golben |
| 4,385,494 | A | 5/1983 | Golben |
| 4,402,187 | A | 9/1983 | Golben et al. |
| 4,598,769 | A | 7/1986 | Robertson |
| 4,796,699 | A | 1/1989 | Upchurch |
| 4,856,595 | A | 8/1989 | Upchurch |
| 4,884,953 | A | 12/1989 | Golben |
| 5,024,270 | A | 6/1991 | Bostick |
| 5,040,602 | A | 8/1991 | Helms |
| 5,058,674 | A | 10/1991 | Schultz et al. |
| 5,074,940 | A | 12/1991 | Ochi et al. |
| 5,089,069 | A | 2/1992 | Ramaswamy et al. |
| 5,101,907 | A | 4/1992 | Schultz et al. |
| 5,117,548 | A | 6/1992 | Griffith et al. |
| 5,155,471 | A | 10/1992 | Ellis et al. |
| 5,163,521 | A | 11/1992 | Pustanyk et al. |
| 5,188,183 | A | 2/1993 | Hopmann et al. |
| 5,197,758 | A | 3/1993 | Lund et al. |
| 5,211,224 | A | 5/1993 | Bouldin |
| 5,238,070 | A | 8/1993 | Schultz et al. |
| 5,279,321 | A | 1/1994 | Krimm |
| 5,316,081 | A | 5/1994 | Baski et al. |
| 5,316,087 | A | 5/1994 | Manke et al. |
| 5,355,960 | A | 10/1994 | Schultz et al. |
| 5,396,951 | A | 3/1995 | Ross |
| 5,452,763 | A | 9/1995 | Owen |
| 5,476,018 | A | 12/1995 | Nakanishi et al. |
| 5,485,884 | A | 1/1996 | Hanley et al. |
| 5,490,564 | A | 2/1996 | Schultz et al. |
| 5,531,845 | A | 7/1996 | Flanigan et al. |
| 5,558,153 | A | 9/1996 | Holcombe et al. |
| 5,573,307 | A | 11/1996 | Wilkinson et al. |
| 5,575,331 | A | 11/1996 | Terrell |
| 5,622,211 | A | 4/1997 | Martin et al. |
| 5,662,166 | A | 9/1997 | Shammai |
| 5,673,556 | A | 10/1997 | Goldben et al. |
| 5,687,791 | A | 11/1997 | Beck et al. |
| 5,700,974 | A | 12/1997 | Taylor |
| 5,725,699 | A | 3/1998 | Hinshaw et al. |
| 6,128,904 | A | 10/2000 | Rosso, Jr. et al. |
| 6,137,747 | A | 10/2000 | Shah et al. |
| 6,172,614 | B1 | 1/2001 | Robison et al. |
| 6,186,226 | B1 | 2/2001 | Robertson |
| 6,196,584 | B1 | 3/2001 | Shirk et al. |
| 6,315,043 | B1 | 11/2001 | Farrant et al. |
| 6,333,699 | B1 | 12/2001 | Zierolf |
| 6,364,037 | B1 | 4/2002 | Brunnert et al. |
| 6,378,611 | B1 | 4/2002 | Helderle |
| 6,382,234 | B1 | 5/2002 | Birckhead et al. |
| 6,438,070 | B1 | 8/2002 | Birchak et al. |
| 6,450,258 | B2 | 9/2002 | Green et al. |
| 6,450,263 | B1 | 9/2002 | Schwendemann |
| 6,470,996 | B1 | 10/2002 | Kyle et al. |
| 6,536,524 | B1 | 3/2003 | Snider |
| 6,561,479 | B1 | 5/2003 | Eldridge |
| 6,568,470 | B2 | 5/2003 | Goodson, Jr. et al. |
| 6,583,729 | B1 | 6/2003 | Gardner et al. |
| 6,584,911 | B2 | 7/2003 | Bergerson et al. |
| 6,598,679 | B2 | 7/2003 | Robertson |
| 6,619,388 | B2 | 9/2003 | Dietz et al. |
| 6,651,747 | B2 | 11/2003 | Chen et al. |
| 6,668,937 | B1 | 12/2003 | Murray |
| 6,672,382 | B2 | 1/2004 | Schultz et al. |
| 6,695,061 | B2 | 2/2004 | Fripp et al. |
| 6,705,425 | B2 | 3/2004 | West |
| 6,717,283 | B2 | 4/2004 | Skinner et al. |
| 6,776,255 | B2 | 8/2004 | West et al. |
| 6,848,503 | B2 | 2/2005 | Schultz et al. |
| 6,880,634 | B2 | 4/2005 | Gardner et al. |
| 6,915,848 | B2 | 7/2005 | Thomeer et al. |
| 6,925,937 | B2 | 8/2005 | Robertson |
| 6,971,449 | B1 | 12/2005 | Robertson |
| 6,973,993 | B2 | 12/2005 | West et al. |
| 6,998,999 | B2 | 2/2006 | Fripp et al. |
| 7,012,545 | B2 | 3/2006 | Skinner et al. |
| 7,063,146 | B2 | 6/2006 | Schultz et al. |
| 7,063,148 | B2 | 6/2006 | Jabusch |
| 7,068,183 | B2 | 6/2006 | Shah et al. |
| 7,082,078 | B2 | 7/2006 | Fripp et al. |
| 7,083,009 | B2 | 8/2006 | Paluch et al. |
| 7,104,276 | B2 | 9/2006 | Einhaus |
| 7,152,657 | B2 | 12/2006 | Bosma et al. |
| 7,152,679 | B2 | 12/2006 | Simpson |
| 7,165,608 | B2 | 1/2007 | Schultz et al. |
| 7,191,672 | B2 | 3/2007 | Ringgenberg et al. |
| 7,195,067 | B2 | 3/2007 | Manke et al. |
| 7,197,923 | B1 | 4/2007 | Wright et al. |
| 7,199,480 | B2 | 4/2007 | Fripp et al. |
| 7,201,230 | B2 | 4/2007 | Schultz et al. |
| 7,210,555 | B2 | 5/2007 | Shah et al |
| 7,234,519 | B2 | 6/2007 | Fripp et al. |
| 7,237,616 | B2 | 7/2007 | Patel |
| 7,246,659 | B2 | 7/2007 | Fripp et al. |
| 7,246,660 | B2 | 7/2007 | Fripp et al. |
| 7,252,152 | B2 | 8/2007 | LoGiudice et al. |
| 7,258,169 | B2 | 8/2007 | Fripp et al. |
| 7,301,472 | B2 | 11/2007 | Kyle et al. |
| 7,301,473 | B2 | 11/2007 | Shah et al. |
| 7,322,416 | B2 | 1/2008 | Burris, II et al. |
| 7,325,605 | B2 | 2/2008 | Fripp et al. |
| 7,337,852 | B2 | 3/2008 | Manke et al. |
| 7,339,494 | B2 | 3/2008 | Shah et al. |
| 7,363,967 | B2 | 4/2008 | Burris, II et al. |
| 7,367,394 | B2 | 5/2008 | Villareal et al. |
| 7,372,263 | B2 | 5/2008 | Edwards |
| 7,373,944 | B2 | 5/2008 | Smith et al. |
| 7,387,165 | B2 | 6/2008 | Lopez de Cardenas et al. |
| 7,395,882 | B2 | 7/2008 | Oldham et al. |
| 7,398,996 | B2 | 7/2008 | Saito et al. |
| 7,404,416 | B2 | 7/2008 | Schultz et al. |
| 7,428,922 | B2 | 9/2008 | Fripp et al. |
| 7,431,335 | B2 | 10/2008 | Khandhadia et al. |
| 7,472,589 | B2 | 1/2009 | Irani et al. |
| 7,472,752 | B2 | 1/2009 | Rogers et al. |
| 7,508,734 | B2 | 3/2009 | Fink et al. |
| 7,510,017 | B2 | 3/2009 | Howell et al. |
| 7,557,492 | B2 | 7/2009 | Fripp et al. |
| 7,559,363 | B2 | 7/2009 | Howell et al. |
| 7,559,373 | B2 | 7/2009 | Jackson et al. |
| 7,595,737 | B2 | 9/2009 | Fink et al. |
| 7,596,995 | B2 | 10/2009 | Irani et al. |
| 7,604,062 | B2 | 10/2009 | Murray |
| 7,610,964 | B2 | 11/2009 | Cox |
| 7,617,871 | B2 | 11/2009 | Surjaatmadja et al. |
| 7,624,792 | B2 | 12/2009 | Wright et al. |
| 7,640,965 | B2 | 1/2010 | Bosma et al. |
| 7,665,355 | B2 | 2/2010 | Zhang et al. |
| 7,669,661 | B2 | 3/2010 | Johnson |
| 7,673,506 | B2 | 3/2010 | Irani et al. |
| 7,673,673 | B2 | 3/2010 | Surjaatmadja et al. |
| 7,699,101 | B2 | 4/2010 | Fripp et al. |

(56) References Cited

U.S. PATENT DOCUMENTS

| | | | |
|---|---|---|---|
| 7,699,102 | B2 | 4/2010 | Storm et al. |
| 7,712,527 | B2 | 5/2010 | Roddy |
| 7,717,167 | B2 | 5/2010 | Storm et al. |
| 7,730,954 | B2 | 6/2010 | Schultz et al. |
| 7,777,645 | B2 | 8/2010 | Shah et al. |
| 7,781,939 | B2 | 8/2010 | Fripp et al. |
| 7,802,627 | B2 | 9/2010 | Hofman et al. |
| 7,804,172 | B2 | 9/2010 | Schultz et al. |
| 7,832,474 | B2 | 11/2010 | Nguy |
| 7,836,952 | B2 | 11/2010 | Fripp |
| 7,856,872 | B2 | 12/2010 | Irani et al. |
| 7,878,255 | B2 | 2/2011 | Howell et al. |
| 7,946,166 | B2 | 5/2011 | Irani et al. |
| 7,946,340 | B2 | 5/2011 | Surjaatmadja et al. |
| 7,963,331 | B2 | 6/2011 | Surjaatmadja et al. |
| 7,987,914 | B2 | 8/2011 | Benton |
| 8,040,249 | B2 | 10/2011 | Shah et al. |
| 8,091,637 | B2 | 1/2012 | Fripp |
| 8,118,098 | B2 | 2/2012 | Hromas et al. |
| 8,140,010 | B2 | 3/2012 | Symons et al. |
| 8,146,673 | B2 | 4/2012 | Howell et al. |
| 8,162,050 | B2 | 4/2012 | Roddy et al. |
| 8,191,627 | B2 | 6/2012 | Hamid et al. |
| 8,196,515 | B2 | 6/2012 | Streibich et al. |
| 8,196,653 | B2 | 6/2012 | Fripp et al. |
| 8,215,404 | B2 | 7/2012 | Makowiecki et al. |
| 8,220,545 | B2 | 7/2012 | Storm, Jr. et al. |
| 8,225,014 | B2 | 7/2012 | Kuhl |
| 8,235,103 | B2 | 8/2012 | Wright et al. |
| 8,235,128 | B2 | 8/2012 | Dykstra et al. |
| 8,240,384 | B2 | 8/2012 | Miller et al. |
| 8,261,839 | B2 | 9/2012 | Fripp et al. |
| 8,276,669 | B2 | 10/2012 | Dykstra et al. |
| 8,276,675 | B2 | 10/2012 | Williamson et al. |
| 8,284,075 | B2 | 10/2012 | Fincher et al. |
| 8,297,367 | B2 | 10/2012 | Chen et al. |
| 8,302,681 | B2 | 11/2012 | Fripp et al. |
| 8,319,657 | B2 | 11/2012 | Godager |
| 8,322,426 | B2 | 12/2012 | Wright et al. |
| 8,327,885 | B2 | 12/2012 | Dykstra et al. |
| 8,356,668 | B2 | 1/2013 | Dykstra et al. |
| 8,376,047 | B2 | 2/2013 | Dykstra et al. |
| 8,387,662 | B2 | 3/2013 | Dykstra et al. |
| 8,397,803 | B2 | 3/2013 | Crabb et al. |
| 8,403,068 | B2 | 3/2013 | Robison et al. |
| 8,459,377 | B2 | 6/2013 | Moyes |
| 8,472,282 | B2 | 6/2013 | Fink et al. |
| 8,474,533 | B2 | 7/2013 | Miller et al. |
| 8,479,831 | B2 | 7/2013 | Dykstra et al. |
| 8,505,639 | B2 | 8/2013 | Robison et al. |
| 8,517,113 | B2 | 8/2013 | Sheffield |
| 8,544,564 | B2 | 10/2013 | Moore et al. |
| 2003/0193329 | A1* | 10/2003 | Relton et al. ..... 324/235 |
| 2004/0156264 | A1 | 8/2004 | Gardner et al. |
| 2004/0227509 | A1 | 11/2004 | Ucan |
| 2005/0189945 | A1 | 9/2005 | Reiderman |
| 2005/0241835 | A1 | 11/2005 | Burris, II et al. |
| 2005/0260468 | A1 | 11/2005 | Fripp et al. |
| 2005/0269083 | A1 | 12/2005 | Burris, II et al. |
| 2006/0118303 | A1 | 6/2006 | Schultz et al. |
| 2006/0144590 | A1 | 7/2006 | Lopez de Cardenas et al. |
| 2007/0189452 | A1 | 8/2007 | Johnson et al. |
| 2008/0135248 | A1 | 6/2008 | Talley et al. |
| 2008/0137481 | A1 | 6/2008 | Shah et al. |
| 2008/0202766 | A1 | 8/2008 | Howell et al. |
| 2008/0236819 | A1 | 10/2008 | Foster et al. |
| 2009/0084546 | A1* | 4/2009 | Ekseth et al. ..... 166/255.1 |
| 2009/0192731 | A1 | 7/2009 | De Jesus et al. |
| 2009/0308588 | A1 | 12/2009 | Howell et al. |
| 2010/0065125 | A1 | 3/2010 | Telfer |
| 2010/0084060 | A1 | 4/2010 | Hinshaw et al. |
| 2010/0201352 | A1 | 8/2010 | Englert |
| 2011/0042092 | A1 | 2/2011 | Fripp et al. |
| 2011/0079386 | A1 | 4/2011 | Fripp et al. |
| 2011/0139445 | A1 | 6/2011 | Fripp et al. |
| 2011/0168390 | A1 | 7/2011 | Fripp et al. |
| 2011/0174484 | A1 | 7/2011 | Wright et al. |
| 2011/0174504 | A1 | 7/2011 | Wright et al. |
| 2011/0192597 | A1 | 8/2011 | Roddy et al. |
| 2011/0199859 | A1 | 8/2011 | Fink et al. |
| 2011/0214853 | A1 | 9/2011 | Robichaux et al. |
| 2011/0240311 | A1* | 10/2011 | Robison et al. ..... 166/373 |
| 2011/0253383 | A1 | 10/2011 | Porter et al. |
| 2011/0266001 | A1 | 11/2011 | Dykstra et al. |
| 2011/0308806 | A9 | 12/2011 | Dykstra et al. |
| 2012/0018167 | A1 | 1/2012 | Konopczynski et al. |
| 2012/0048531 | A1 | 3/2012 | Marzouk et al. |
| 2012/0075113 | A1 | 3/2012 | Loi et al. |
| 2012/0111577 | A1 | 5/2012 | Dykstra et al. |
| 2012/0146805 | A1 | 6/2012 | Vick, Jr. et al. |
| 2012/0152527 | A1 | 6/2012 | Dykstra et al. |
| 2012/0179428 | A1 | 7/2012 | Dykstra et al. |
| 2012/0186819 | A1 | 7/2012 | Dagenais et al. |
| 2012/0205120 | A1 | 8/2012 | Howell |
| 2012/0205121 | A1 | 8/2012 | Porter et al. |
| 2012/0211243 | A1 | 8/2012 | Dykstra et al. |
| 2012/0234557 | A1 | 9/2012 | Dykstra et al. |
| 2012/0241143 | A1 | 9/2012 | Wright et al. |
| 2012/0255739 | A1 | 10/2012 | Fripp et al. |
| 2012/0255740 | A1 | 10/2012 | Fripp et al. |
| 2012/0279593 | A1 | 11/2012 | Fripp et al. |
| 2012/0313790 | A1 | 12/2012 | Heijnen et al. |
| 2012/0318511 | A1 | 12/2012 | Dykstra et al. |
| 2012/0318526 | A1 | 12/2012 | Dykstra et al. |
| 2012/0323378 | A1 | 12/2012 | Dykstra et al. |
| 2013/0000922 | A1 | 1/2013 | Skinner et al. |
| 2013/0014940 | A1 | 1/2013 | Fripp et al. |
| 2013/0014941 | A1 | 1/2013 | Tips et al. |
| 2013/0014955 | A1 | 1/2013 | Fripp et al. |
| 2013/0014959 | A1 | 1/2013 | Tips et al. |
| 2013/0020090 | A1 | 1/2013 | Fripp et al. |
| 2013/0048290 | A1 | 2/2013 | Howell et al. |
| 2013/0048291 | A1 | 2/2013 | Merron et al. |
| 2013/0048298 | A1 | 2/2013 | Merron et al. |
| 2013/0048299 | A1 | 2/2013 | Fripp et al. |
| 2013/0048301 | A1 | 2/2013 | Gano et al. |
| 2013/0075107 | A1 | 3/2013 | Dykstra et al. |
| 2013/0092381 | A1 | 4/2013 | Dykstra et al. |
| 2013/0092382 | A1 | 4/2013 | Dykstra et al. |
| 2013/0092392 | A1 | 4/2013 | Dykstra et al. |
| 2013/0092393 | A1 | 4/2013 | Dykstra et al. |
| 2013/0098614 | A1 | 4/2013 | Dagenais et al. |
| 2013/0106366 | A1 | 5/2013 | Fripp et al. |
| 2013/0112423 | A1 | 5/2013 | Dykstra et al. |
| 2013/0112424 | A1 | 5/2013 | Dykstra et al. |
| 2013/0112425 | A1 | 5/2013 | Dykstra et al. |
| 2013/0122296 | A1 | 5/2013 | Rose et al. |
| 2013/0140038 | A1 | 6/2013 | Fripp et al. |
| 2013/0153238 | A1 | 6/2013 | Fripp et al. |
| 2013/0180727 | A1 | 7/2013 | Dykstra et al. |
| 2013/0180732 | A1 | 7/2013 | Acosta et al. |
| 2013/0186634 | A1 | 7/2013 | Fripp et al. |
| 2013/0192829 | A1 | 8/2013 | Fadul et al. |

FOREIGN PATENT DOCUMENTS

| | | | |
|---|---|---|---|
| WO | 0220942 | A1 | 3/2002 |
| WO | 2004018833 | A1 | 3/2004 |
| WO | 2004099564 | A2 | 11/2004 |
| WO | 2010002270 | A2 | 1/2010 |
| WO | 2010111076 | A2 | 9/2010 |
| WO | 2011021053 | A2 | 2/2011 |
| WO | 2011087721 | A1 | 7/2011 |
| WO | 2012078204 | A1 | 6/2012 |
| WO | 2012082248 | A1 | 6/2012 |
| WO | 2013032687 | A2 | 3/2013 |
| WO | 2013032687 | A3 | 3/2013 |
| WO | 2014092836 | A1 | 6/2014 |

OTHER PUBLICATIONS

Filing receipt and specification for provisional patent application entitled "Wellbore Servicing Tools, Systems and Methods Utilizing

(56) References Cited

OTHER PUBLICATIONS

Near-Field Communication," by Zachary William Walton, et al., filed Mar. 12, 2013 as U.S. Appl. No. 61/778,312.
Filing receipt and specification for patent application entitled "Remotely Activated Down Hole Systems and Methods," by Frank V. Acosta, et al., filed Mar. 7, 2012 as U.S. Appl. No. 13/414,016.
Filing receipt and specification for patent application entitled "External Casing Packer and Method of Performing Cementing Job," by Lonnie Helms, et al., filed Mar. 7, 2012 as U.S. Appl. No. 13/414,140.
Filing receipt and specification for patent application entitled "Method of Completing a Multi-Zone Fracture Stimulation Treatment of a Wellbore," by Steven G. Streich, et al., filed Sep. 21, 2012 as U.S. Appl. No. 13/624,173.
Filing receipt and specification for patent application entitled "Pressure Relief-Assisted Packer," by Lonnie Carl Helms, et al., filed Oct. 25, 2012 as U.S. Appl. No. 13/660,678.
Filing receipt and specification for patent application entitled "Gas Generator for Pressurizing Downhole Samples," by Scott L. Miller, et al., filed May 30, 2013 as U.S. Appl. No. 13/905,859.
Filing receipt and specification for patent application entitled "Wellbore Servicing Tools, Systems and Methods Utilizing Downhole Wireless Switches," by Michael Linley Fripp, et al., filed on May 31, 2013 as U.S. Appl. No. 13/907,593.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/913,881.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,004.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,114.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,177.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,216.
Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,238.
Filing receipt and specification for International application entitled "Pressure Equalization for Dual Seat Ball Valve," filed Mar. 8, 2013 as International application No. PCT/US2013/027666.
Filing receipt and specification for International application entitled "Autofill and Circulation Assembly and Method of Using the Same," filed Mar. 5, 2013 as International application No. PCT/US2013/027674.
Foreign communication from a related counterpart application—International Search Report and Written Opinion, PCT/US2010/061047, Jun. 23, 2011, 7 pages.
Foreign communication from a related counterpart application—International Search Report and Written Opinion, PCT/US2011/036686, Nov. 30, 2011, 8 pages.
Foreign communication from a related counterpart application—International Preliminary Report on Patentability, PCT/US2011/036686, Jun. 12, 2013, 5 pages.
Foreign communication from a related counterpart application—International Search Report and Written Opinion, PCT/US2012/050762, Mar. 11, 2013, 12 pages.
Halliburton brochure entitled "Armada™ Sampling System," Sep. 2007, 2 pages.
Halliburton Drawing 672.03800, May 4, 1994, p. 1 of 2.
Halliburton Drawing 672.03800, May 4, 1994, p. 2 of 2.
Halliburton Drawing 626.02100, Apr. 20, 1999, 2 pages.
Magneta Electromagnetic Clutches and Brakes catalog, Jan. 2004, 28 pages, Magneta GmbH & Co KG.
Office Action dated Dec. 24, 2012 (26 pages), U.S. Appl. No. 12/688,058, filed on Jan. 15, 2010.
Office Action dated Dec. 23, 2011 (34 pages), U.S. Appl. No. 12/688,058, filed on Jan. 15, 2010.
Office Action dated Dec. 22, 2011 (30 pages), U.S. Appl. No. 12/965,859, filed on Dec. 11, 2010.
Ogura product information, "Electromagnetic Clutch/Brake," http://www.ogura-clutch.com/products.html?category=2&by=type&no=1, Mar. 4, 2009, 4 pages, Ogura Industrial Corp.
Paus, Annika, "Near Field Communication in Cell Phones," Jul. 24, 2007, pp. 1-22 plus 1 cover and 1 content pages.
Sanni, Modiu L., et al., "Reservoir Nanorobots," Saudi Aramco Journal of Technology, Spring 2008, pp. 44-52.
Ward, Matt, et al., "RFID: Frequency, standards, adoption and innovation," JISC Technology and Standards Watch, May 2006, pp. 1-36.
Office Action dated Sep. 19, 2013 (17 pages), U.S. Appl. No. 12/688,058, filed Jan. 15, 2010.
Office Action dated Sep. 19, 2013 (30 pages), U.S. Appl. No. 12/965,859, filed Dec. 11, 2010.
Office Action dated Dec. 3, 2013 (46 pages), U.S. Appl. No. 13/905,859, filed May 30, 2013.
Foreign communication from a related counterpart application—International Preliminary Report on Patentability, PCT/US2010/061047, Jul. 17, 2012, 5 pages.
International Search Report and Written Opinion issued in related PCT Application No. PCT/US2014/020307 mailed Nov. 19, 2014, 11 pages.
Foreign communication from a related counterpart application—International Search Report and Written Opinion, PCT/US2013/061386, Apr. 10, 2014, 12 pages.
Filing receipt and specification for patent application entitled "Method and Apparatus for Magnetic Pulse Signature Actuation," by Zachary W. Walton, et al., filed Feb. 28, 2013 as U.S. Appl. No. 13/781,093.
Advisory Action dated Jul. 1, 2014 (3 pages), U.S. Appl. No. 12/688,058, filed Jan. 15, 2010.
Foreign communication from a related counterpart application—Australian Office Action, AU Application No. 2010341610, Feb. 27, 2014, 5 pages.
Notice of Allowance dated Jul. 15, 2014 (28 pages), U.S. Appl. No. 12/688,058, filed Jan. 15, 2010.
Office Action (Final) dated Mar. 10, 2014 (13 pages), U.S. Appl. No. 12/688,058, filed Jan. 15, 2010.
Office Action (Final) dated May 9, 2014 (16 pages), U.S. Appl. No. 12/965,859, filed Dec. 11, 2010.
Office Action (Final) dated Jul. 22, 2014 (21 pages), U.S. Appl. No. 13/905,859, filed May 30, 2013.
International Preliminary Report on Patentability issued in related PCT Application No. PCT/US2014/020307, mailed Sep. 24, 2015 (8 pages).

* cited by examiner

DUAL MAGNETIC SENSOR ACTUATION ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

This disclosure relates generally to equipment utilized and operations performed in conjunction with a subterranean well and, in an example described below, more particularly provides for injection of fluid into one or more selected zones in a well, and provides for magnetic field sensing actuation of well tools. It can be beneficial in some circumstances to individually, or at least selectively, actuate one or more well tools in a well. Improvements are continuously needed in the art which may be useful in operations such as selectively injecting fluid into formation zones, selectively producing from multiple zones, actuating various types of well tools, etc.

SUMMARY

Disclosed herein is a wellbore servicing system comprising a tubular string disposed within a wellbore, and a first well tool incorporated with the tubular string and comprising a housing comprising one or more ports and generally defining a flow passage, an actuator disposed within the housing, a dual magnetic sensor actuation assembly (DMSAA) disposed within the housing and in signal communication with the actuator and comprising a first magnetic sensor positioned up-hole relative to a second magnetic sensor, and an electronic circuit comprising a counter, and wherein, the DMSAA is configured to detect a magnetic signal and to determine the direction of movement of the magnetic device emitting the magnetic signal, and a sleeve slidably positioned within the housing and transitional from a first position to a second position, wherein, when the sleeve is in the first position, the sleeve is configured to prevent a route of fluid communication via the one or more ports of the housing and, when the sleeve is in the second position, the sleeve is configured to allow fluid communication via the one or more ports of the housing, wherein, the sleeve is allowed to transition from the first position to the second position upon actuation of the actuator, and wherein the actuator actuated upon recognition of a predetermined quantity of magnetic signals traveling in a particular flow direction.

Also disclosed herein is a wellbore servicing tool comprising a housing comprising one or more ports and generally defining a flow passage, a first magnetic sensor and a second magnetic sensor disposed within the housing, wherein the first magnetic sensor is positioned up-hole of the second magnetic sensor, an electronic circuit coupled to the first magnetic sensor and the second magnetic sensor; and a memory coupled to the electronic circuit, wherein the memory comprises instructions that cause the electronic circuit to detect a magnetic device within the housing, determine the flow direction of the magnetic device through the housing, and adjust a counter in response to the detection of the magnetic device and the determination of the flow direction of the magnetic device through the housing.

Further disclosed herein is a wellbore servicing method comprising positioning a tubular string comprising a well tool comprising a dual magnetic sensor actuation assembly (DMSAA) within a wellbore, wherein the well tool is configured to disallow a route of fluid communication between the exterior of the well tool and an axial flowbore of the well tool, introducing one or more magnetic devices to the axial flowbore of the well tool, wherein each of the magnetic devices transmits a magnetic signal, detecting the one or more magnetic devices, determining the flow direction of the one or more magnetic devices, adjusting a magnetic device counter in response to the detection and the flow direction of the magnetic devices, actuating the well tool in recognition of a predetermined quantity of predetermined magnetic signals traveling in a particular flow direction, wherein the well tool is reconfigured to allow a route of fluid communication between the exterior of the well tool and the axial flowbore of the well tool.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
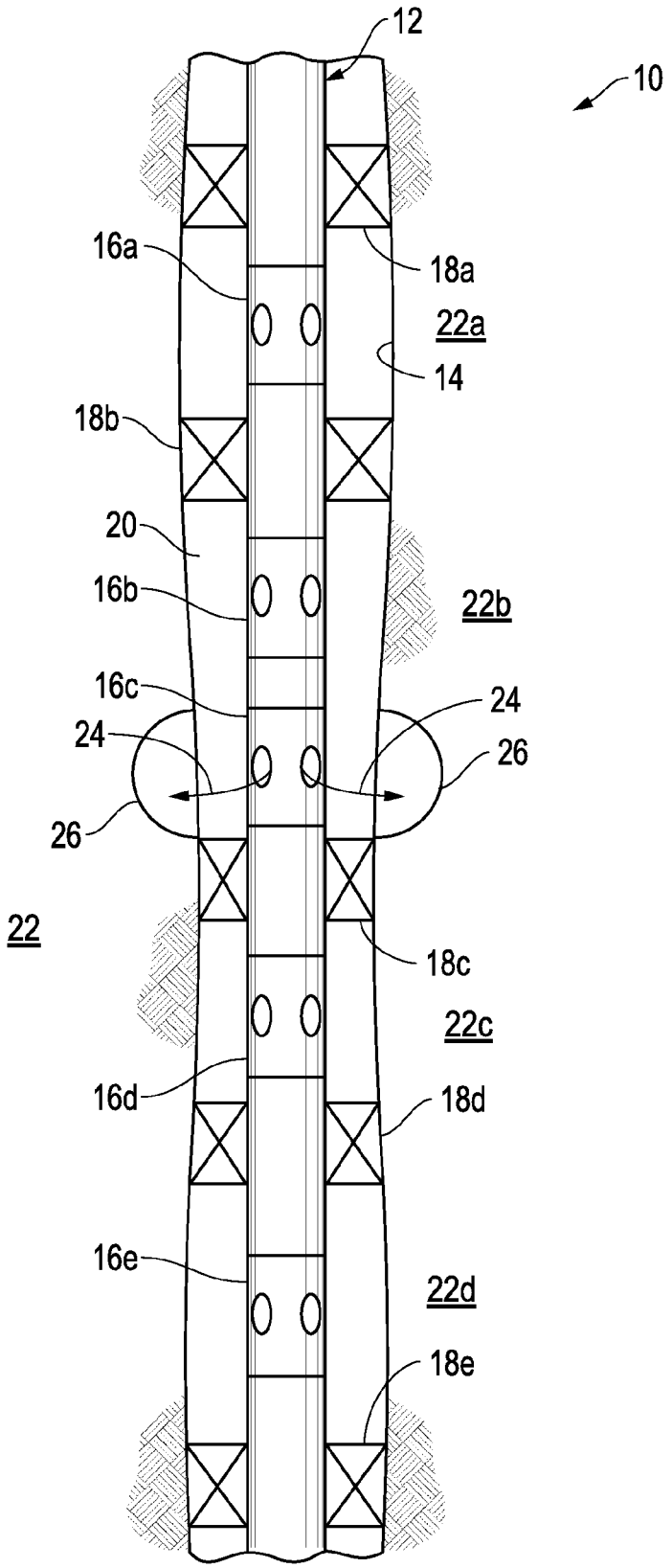
FIG. 1 is a representative partially cross-sectional view of a well system which may embody principles of this disclosure.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

In an embodiment as illustrated in FIG. 1, a wellbore servicing system 10 for use with a well and an associated method are disclosed herein. For example, in an embodiment, a tubular string 12 comprising multiple injection valves 16*a-e* and a plurality of packers 18*a-e* interconnected therein is positioned in a wellbore 14.

In an embodiment, the tubular string 12 may be of the type known to those skilled in the art such as a casing, a liner, a tubing, a production string, a work string, a drill string, a completion string, a lateral, or any type of tubular string may be used as would be appreciated by one of ordinary skill in the art upon viewing this disclosure. In an embodiment, the packers 18*a-e* may be configured to seal an annulus 20 formed radially between the tubular string 12 and the wellbore 14. In such an embodiment, the packers 18*a-e* may be configured for sealing engagement with an uncased or open hole wellbore 14. In an alternative embodiment, for example, if the wellbore is cased or lined, then cased hole-type packers may be used instead. For example, in an embodiment, swellable, inflatable, expandable and/or other types of packers may be used, as appropriate for the well conditions. In an alternative embodiment, no packers may be used, for example, the tubular string 12 could be expanded into contact with the wellbore 14, the tubular string 12 could be cemented in the wellbore, etc.

In the embodiment of FIG. 1, the injection valves 16*a-e* may be configured to selectively permit fluid communication between an interior of the tubular string 12 (e.g., a flowbore) and each section of the annulus 20 isolated between two of the packers 18*a-e*. In such an embodiment, each section of the annulus 20 is in fluid communication with one or more corresponding earth formation zones 22*a-d*. In an alternative embodiment, if the packers 18*a-e* are not used, the injection valves 16*a-e* may be placed in communication with the individual zones 22*a-d* (e.g., with perforations, etc.). In an embodiment, the zones 22*a-d* may be sections of a same formation 22 or sections of different formations. For example, in an embodiment, each zone 22*a-d* may be associated with one or more of the injection valves 16*a-e*.

In the embodiment of FIG. 1, two injection valves 16*b,c* are associated with the section of the annulus 20 isolated between the packers 18*b,c*, and this section of the annulus is in communication with the associated zone 22*b*. It will be appreciated that any number of injection valves may be associated with a zone (e.g., zones 22*a-d*).

In an embodiment, it may be beneficial to initiate fractures 26 at multiple locations in a zone (e.g., in tight shale formations, etc.), in such cases the multiple injection valves can provide for selectively communicating (e.g., injecting) fluid 24 at multiple stimulation (e.g., fracture initiation) points along the wellbore 14. For example, as illustrated in FIG. 1, the valve 16*c* has been opened and fluid 24 is being injected into the zone 22*b*, thereby forming the fractures 26. Additionally, in an embodiment, the other valves 16*a,b,d,e* are closed while the fluid 24 is being flowed out of the valve 16*c* and into the zone 22*b* thereby enabling all of the fluid 24 flow to be directed toward forming the fractures 26, with enhanced control over the operation at that particular location.

In an alternative embodiment, multiple valves 16*a-e* could be open while the fluid 24 is flowed into a zone of an earth formation 22. In the well system 10, for example, both of the valves 16*b,c* could be open while the fluid 24 is flowed into the zone 22*b* thereby enabling fractures to be formed at multiple fracture initiation locations corresponding to the open valves. In an embodiment, one or more of the valves 16*a-e* may be configured to operate at different times. For example, in an embodiment, one set (such as valves 16*b,c*) may be opened at one time and another set (such as valve 16*a*) could be opened at another time. In an alternative embodiment, one or more sets of the valves 16*a-e* may be opened substantially simultaneously. Additionally, in an embodiment, it may be preferable for only one set of the valves 16*a-e* to be open at a time, so that the fluid 24 flow can be concentrated on a particular zone, and so flow into that zone can be individually controlled.

It is noted that the wellbore servicing system 10 and method is described here and depicted in the drawings as merely one example of a wide variety of possible systems and methods which can incorporate the principles of this disclosure. Therefore, it should be understood that those principles are not limited in any manner to the details of the wellbore servicing system 10 or associated method, or to the details of any of the components thereof (for example, the tubular string 12, the wellbore 14, the valves 16*a-e*, the packers 18*a-e*, etc.). For example, it is not necessary for the wellbore 14 to be vertical as depicted in FIG. 1, for the wellbore to be uncased, for there to be five each of the valves 16*a-e* and packers 18*a-e*, for there to be four of the zones 22*a-d*, for fractures 26 to be formed in the zones, for the fluid 24 to be injected, for the treatment of zones to progress in any particular order, etc. In an embodiment, the fluid 24 may be any type of fluid which is injected into an earth formation, for example, for stimulation, conformance, acidizing, fracturing, water-flooding, steam-flooding, treatment, gravel packing, cementing, or any other purpose as would be appreciated by one of ordinary skill in the art upon viewing this disclosure. Thus, it will be appreciated that the principles of this disclosure are applicable to many different types of well systems and operations.

In an additional or alternative embodiment, the principles of this disclosure could be applied in circumstances where fluid is not only injected, but is also (or only) produced from the formation 22. In such an embodiment, the fluid 24 (e.g., oil, gas, water, etc.) may be produced from the formation 22. Thus, well tools other than injection valves can benefit from the principles described herein.

Thus, it should be understood that the scope of this disclosure is not limited to any particular positioning or arrangement of various components of the injection valve 16. Indeed, the principles of this disclosure are applicable to a large variety of different configurations, and to a large variety of different types of well tools (e.g., packers, circulation valves, tester valves, perforating equipment, completion equipment, sand screens, etc.).

Referring to FIGS. 2-6, 9, 10A-10B, 15A-15B, and 16A-16B, in an embodiment, the injection valve 16 comprises a housing 30, an actuator 50, a sleeve 32, and a dual magnetic sensor actuation assembly (DMSAA) 100. While embodiments of the injector valve 16 are disclosed with respect to FIGS. 2-6, 9, 10A-10B, 15A-15B, and 16A-16B, one of ordinary skill in the art upon viewing this disclosure, will recognize suitable alternative configurations. As such, while embodiments of an injection valve 16 may be disclosed with reference to a given configuration (e.g., as will be disclosed with respect to one or more figures herein), this disclosure should not be construed as limited to such embodiments.

Referring to FIGS. 2, 3, 9, 10A-10B, and 15A-15B, an embodiment of the injection valve 16 is illustrated in a first configuration. In an embodiment, when the injection valve 16 is in the first configuration, also referred to as a run-in configuration/mode or installation configuration/mode, the injection valve 16 may be configured so as to disallow a route of fluid communication between the flow passage 36 of the injection valve 16 and the exterior of the injection valve 16 (e.g., the wellbore). In an embodiment, as will be disclosed herein, the injection valve 16 may be configured to transition from the first configuration to the second configuration upon experiencing a predetermined quantity of magnetic signals from one or more signaling members moving in a particular direction (e.g., upon experiencing 1, 2, 3, 4, 5, 6, 7, 8, 9, 10, 11, 12, or more magnetic signals from signaling members moving in a downward direction).

Referring to FIGS. 4-6 and 16A-16B, the injection valve 16 is illustrated in a second configuration. In an embodiment, when the injection valve 16 is in the second configuration, the injection valve 16 may be configured so as to allow a route of fluid communication between the flow passage 36 of the injection valve 16 and the exterior of the injection valve 16 (e.g., the wellbore). In an embodiment, the injection valve 16 may remain in the second configuration upon transitioning to the second configuration.

In an embodiment, the housing 30 may be characterized as a generally tubular body. The housing 30 may also be characterized as generally defining a longitudinal flowbore (e.g., the flow passage 36). Additionally, in an embodiment, the housing 30 may comprise one or more recesses or chambers formed by one or more interior and/or exterior portions of the housing 30, as will be disclosed herein. In an embodiment, the housing 30 may be configured for connection to and/or incorporation within a string, such as the tubular 12. For example, the housing 30 may comprise a suitable means of connection to the tubular 12. For instance, in an embodiment, the housing 30 may comprise internally and/or externally threaded surfaces as may be suitably employed in making a threaded connection to the tubular 12. In an additional or alternative embodiment, the housing 30 may further comprise a suitable connection interface for making a connection with a downhole portion of the tubular 12. Alternatively, an injection valve like injection valve 16 may be incorporated within a tubular like tubular 12 by any suitable connection, such as for example, one or more quick connector type connections. Suitable connections to a tubular member will be known to those of ordinary skill in the art viewing this disclosure.

In an embodiment, the housing 30 may be configured to allow one or more sleeves to be slidably positioned therein, as will be disclosed herein. Additionally, in an embodiment, the housing 30 may further comprise a plurality of ports configured to provide a route of fluid communication between the exterior of the housing 30 and the flow passage 36 of the housing 30, when so-configured, as will be disclosed herein. For example, in the embodiment of FIG. 2, the injection valve 16 comprises one or more ports or openings (e.g., openings 28) disposed about the housing 30 and providing a route of fluid communication between the flow passage 36 and the exterior of the housing 30, as will be disclosed herein.

In an embodiment, the sleeve 32 may generally comprise a cylindrical or tubular structure. In an embodiment, the sleeve 32 may be slidably fit against an interior bore surface of the housing 30 in a fluid-tight or substantially fluid-tight manner. Additionally, in an embodiment, the sleeve 32 and/or the housing 30 may further comprise one or more suitable seals (e.g., an O-ring, a T-seal, a gasket, etc.) disposed at an interface between the outer cylindrical surface of the sleeve 32 and an inner housing surface, for example, for the purpose of prohibiting and/or restricting fluid movement via such an interface.

Referring to the embodiments of FIGS. 2-6, 9, 10A, 15A, and 16A, the sleeve 32 may be slidably positioned within the housing 30. For example, the sleeve 32 may be slidably movable between various longitudinal positions with respect to the housing 30. Additionally, the relative position of the sleeve 32 may determine if the one or more ports (e.g., the openings 28) of the housing 30 are able to provide a route of fluid communication.

Referring to the embodiments of FIGS. 2, 3, 9, 10A, and 15A, when the injection valve 16 is configured in the first configuration, the sleeve 32 is in a first position with respect to the housing 30. In such an embodiment, the sleeve 32 may be releasably coupled to the housing 30, for example, via a shear pin, a snap ring, etc., for example, such that the sleeve 32 is fixed relative to the housing 30. For example, in the embodiment of FIG. 2, the sleeve 32 is releasably coupled to the housing 30 via a shear pin 34. In an additional or alternative embodiment, the sleeve 32 may remain in the first position via an application of a fluid pressure (e.g., a supportive fluid contained within a chamber within the housing 30) onto one or more portions of the sleeve 32, as will be disclosed herein.

Referring to the embodiments of FIGS. 4-6, and 16A, when the injection valve 16 is configured in the second configuration, the sleeve 32 is in a second position with respect to the housing 30. In an embodiment, when the sleeve 32 is in the second position, the injection valve 16 may be configured to provide bidirectional fluid communication between the exterior of the injection valve 16 and the flow passage 36 of the injection valve 16, for example, via the openings 28. In an embodiment, when the sleeve 32 is in the second position, the sleeve 32 may no longer be coupled to the housing 30 (e.g., not fixed or locked into position longitudinally). In an alternative embodiment, when the sleeve 32 is in the second position, the sleeve 32 may be retained in the second position (e.g., via a snap ring).

In an embodiment, the sleeve 32 may be configured so as to be selectively moved downward (e.g., down-hole). For example, in the embodiments, of FIGS. 2-6, 9, 10A, 15A, and 16A, the injection valve 16 may be configured to transition from the first configuration to the second configuration upon receipt of a predetermined quantity of magnetic signals from signal members moving in a particular direction. For example, the injection valve 16 may be configured such that communicating a magnetic device which transmits a magnetic signal within the flow passage 36 causes the actuator 50 to actuate, as will be disclosed herein.

In an embodiment, the sleeve 32 may further comprise a mandrel 54 comprising a retractable seat 56 and a piston 52. For example, in the embodiment of FIG. 2, the retractable seat 56 may comprise resilient collets 58 (e.g., collet fingers) and may be configured such that the resilient collets 58 may be positioned within an annular recess 60 of the housing 30. Additionally, in an embodiment, the retractable seat 56 may be configured to sealingly engage and retain an obturating member (e.g., a magnetic device, a ball, a dart, a plug, etc.). For example, in an embodiment, following the injection valve 16 experiencing the predetermined quantity of magnetic signals from signaling members moving in a particular direction (e.g., upon movement of the mandrel 54), the resilient collets 58 may be configured to deflect radially inward (e.g., via an inclined face 62 of the recess 60) and, thereby transition the retractable seat 56 to a sealing position. In such an embodiment, the retractable seat 56 may be configured such that an engagement with an obturating member (e.g., a magnetic device, a ball, a dart, a plug, etc.) allows a pressure to be applied onto the obturating member and thereby applies a force onto the obturating member and/or the mandrel 54, for example, so as to apply a force to the sleeve 32, for example, in a down-hole direction, as will be disclosed herein. In such an embodiment, the applied force in the down-hole direction may be sufficient to shear one or more shear pins (e.g., shear pins 34) and/or to transition the sleeve 32 from the first position to the second position with respect to the housing 30.

Figure 4:
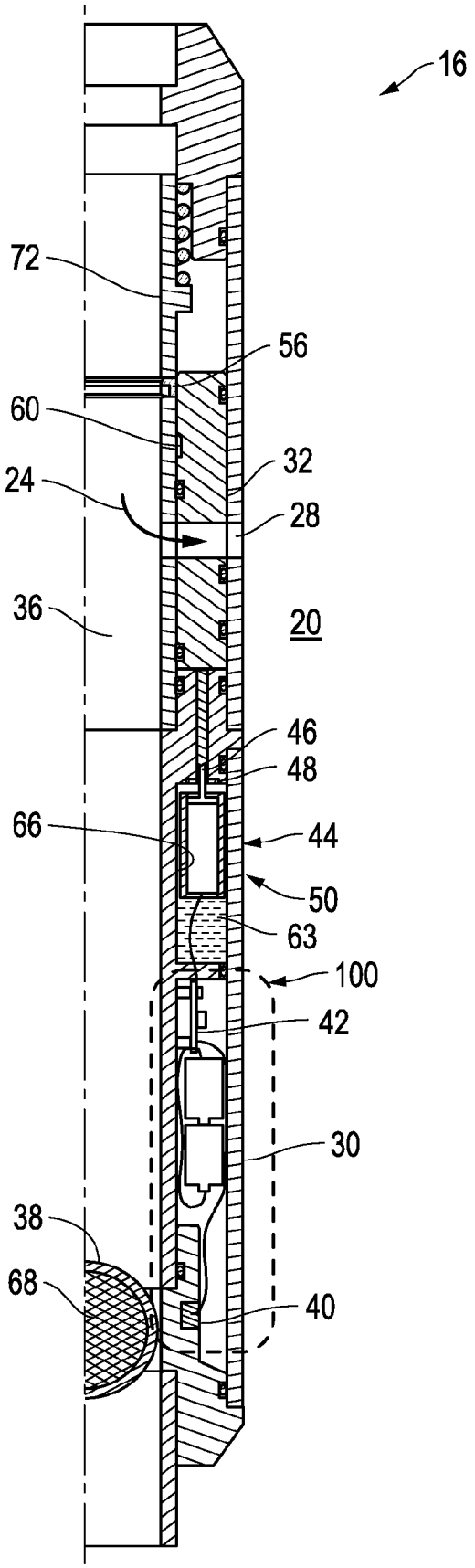
Figure 5:
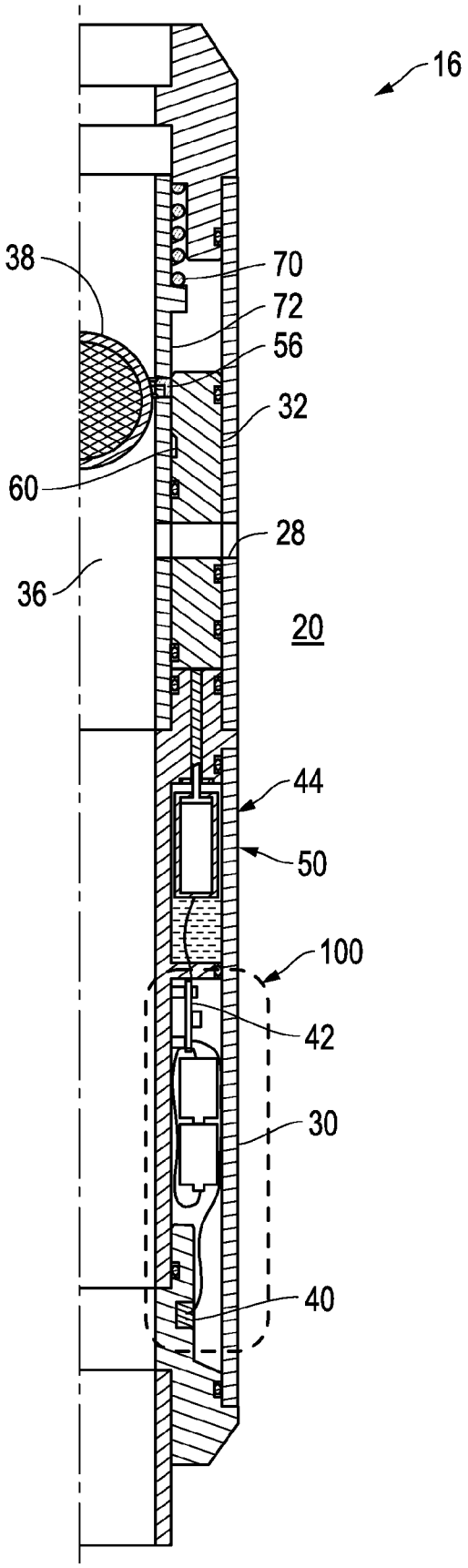
Figure 6:
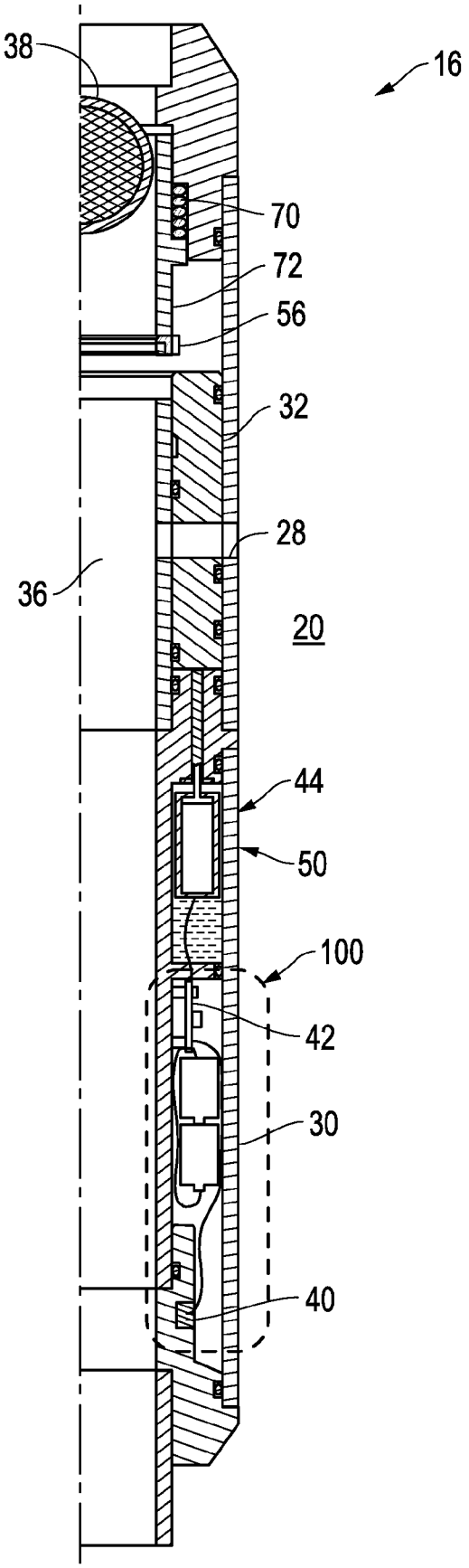

In the embodiments of FIGS. 3-6, the retractable seat 56 may be in the form of an expandable ring which may be configured to extend radially inward to its sealing position by the downward displacement of the sleeve 32, as shown in FIG. 4. Additionally, in an embodiment, the retractable seat 56 may be configured to transition to a retracted position via an application of a force onto the retractable seat 56, for example, via an upward force applied by an obturing member (e.g., a magnetic device 38). For example, in the embodiment of FIG. 5, the injection valve 16 may be configured such that when a magnetic device 38 is retrieved from the flow passage 36 (e.g., via a reverse or upward flow) of fluid through the flow passage 36) the magnetic device 38 may engage the retractable seat 56. In such an embodiment as illustrated in FIG. 6, the injection valve 16 may be further configured such that the engagement between the magnetic device 38 and the retractable seat 56 causes an upward force onto a retainer sleeve 72. For example, in such an embodiment, the upward force may be sufficient to overcome a downward biasing force (e.g., via a spring 70 applied to a retainer sleeve 72), thereby allowing the retractable seat 56 to expand radially outward and, thereby transition the retractable seat 56 to the retracted position. In such an embodiment, when the retractable seat 56 is in the retracted position, the injection valve 16 may be configured to allow the obturating member 38 to be conveyed upward in the direction of the earth's surface.

In an embodiment, the actuator 50 may comprise a piercing member 46 and/or a valve device 44. In an embodiment, the piercing member 46 may be driven by any means, such as, by an electrical, hydraulic, mechanical, explosive, chemical, or any other type of actuator as would be appreciated by one of ordinary skill in the art upon viewing this disclosure. Other types of valve devices 44 (such as those described in U.S. patent application Ser. No. 12/688,058 and/or U.S. patent application Ser. No. 12/353,664, the entire disclosures of which are incorporated herein by this reference) may be used, in keeping with the scope of this disclosure.

Figure 2:
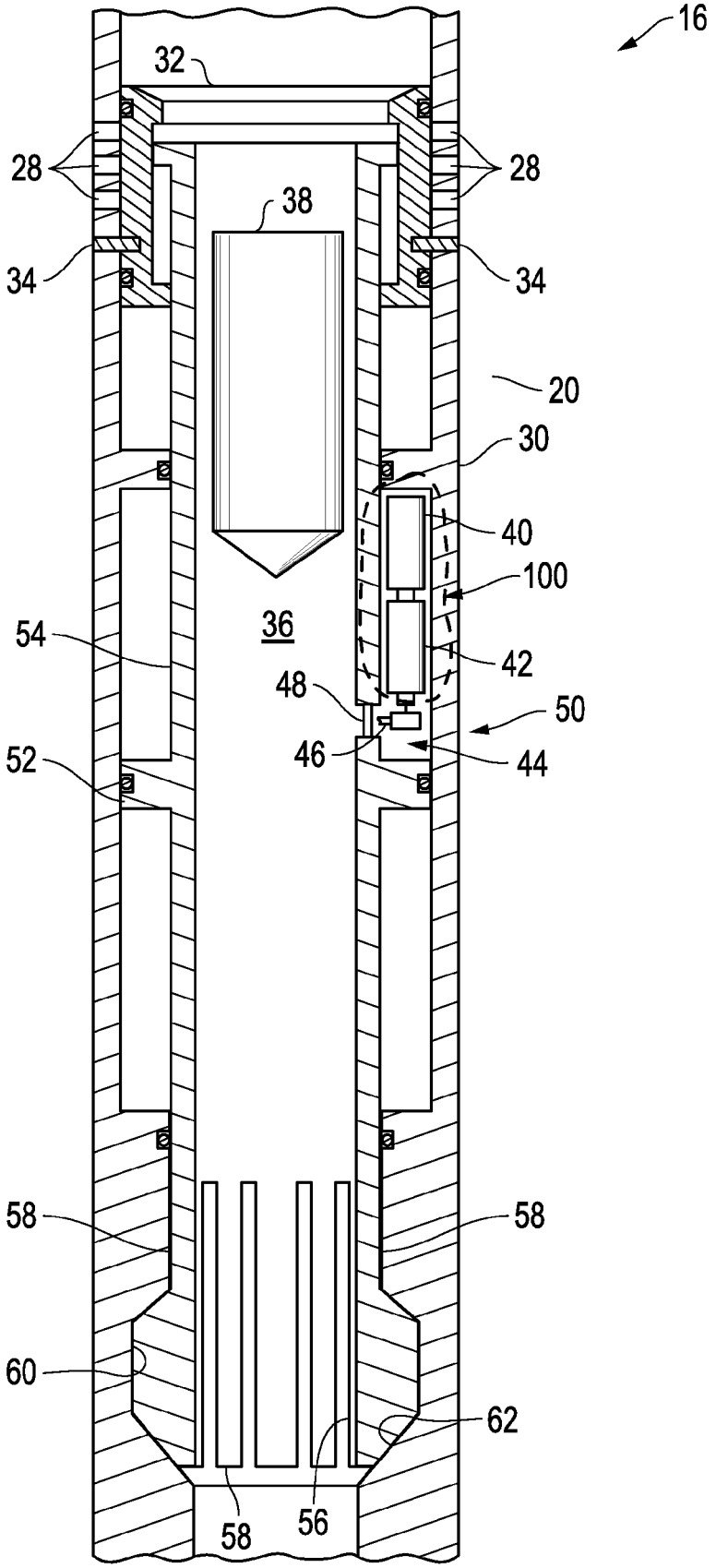
FIG. 2 is a representative partially cross-sectional view of an injection valve which may be used in the well system and/or method, and which can embody the principles of this disclosure.
Figure 3:
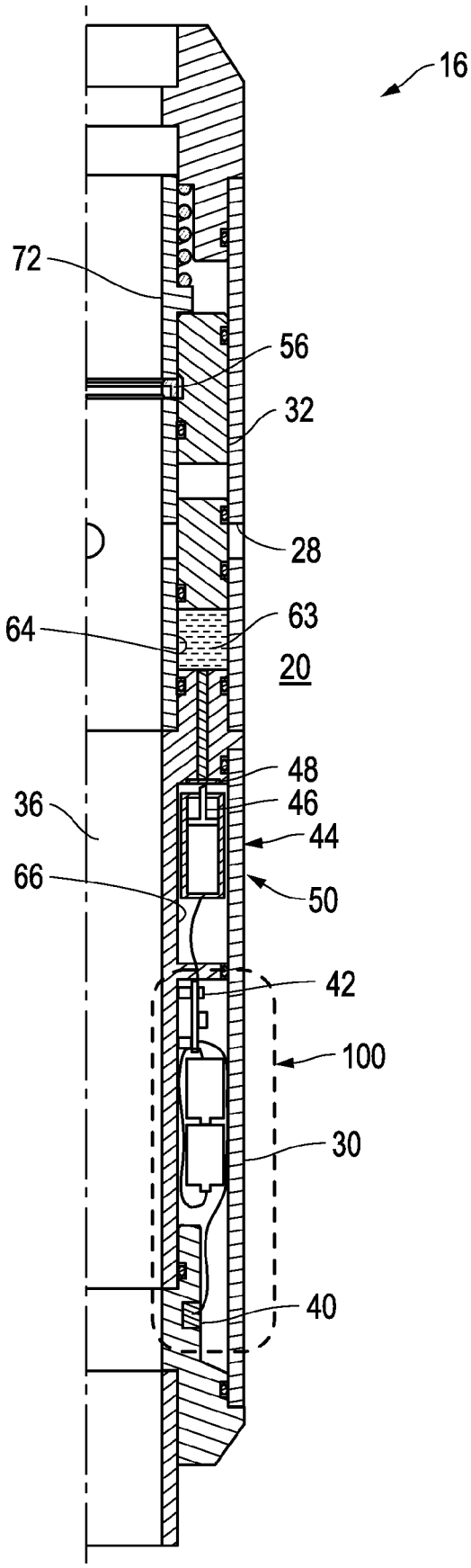
FIGS. 3-6 are a representative cross-sectional views of another example of the injection valve, in run-in, actuated and reverse flow configurations, respectively.

In an embodiment as illustrated in FIG. 2, the injector valve 16 may be configured such that when the valve device 44 is opened, a piston 52 on a mandrel 54 becomes unbalanced (e.g., via a pressure differential generated across the piston 52) and the piston 52 displaces in a down-hole direction. In such an embodiment, the pressure differential generated across the piston 52 (e.g., via an application of fluid pressure from the flow passage 36) may be sufficient to transition the sleeve 32 from the first position (e.g., a closed position) to the second position (e.g., an open position) and/or to shear one or more shear pins (e.g., shear pins 34).

Figure 9:
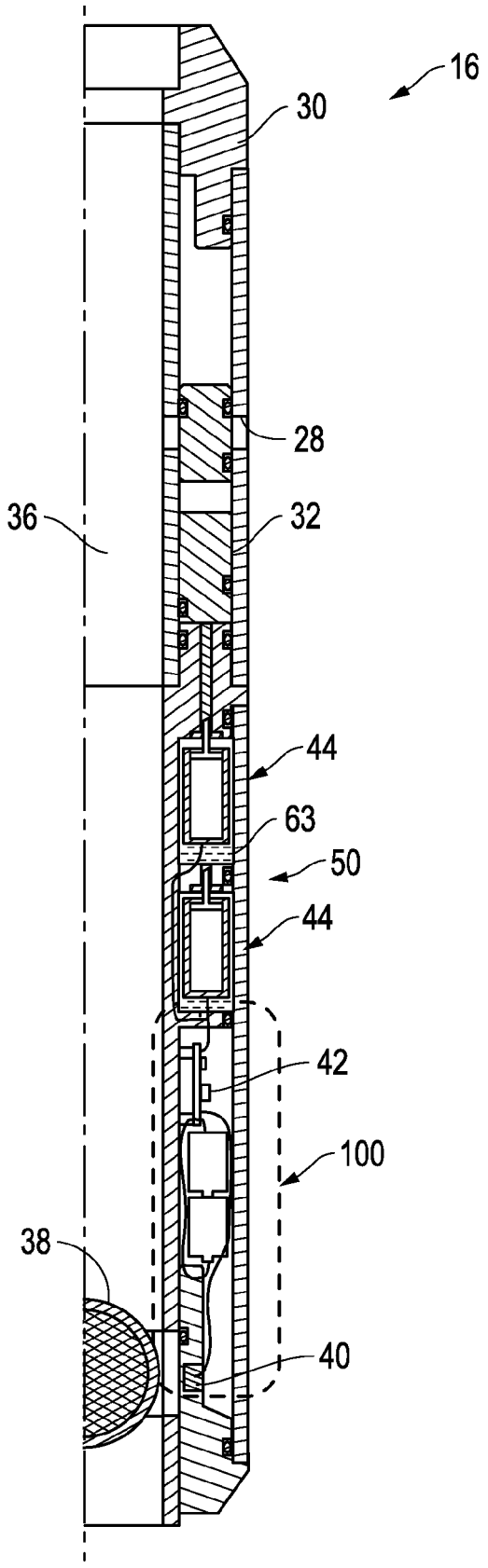
FIG. 9 is a representative cross-sectional view of another example of the injection valve.

In the embodiment shown FIG. 9, the actuator 50 may comprise two or more valve devices 44. In such an embodiment, the injection valve 16 may be configured such that when a first valve device 44 is actuated, a sufficient amount of a supportive fluid 63 is drained (e.g., allowed to pass out of a chamber, allowed to pass into a chamber, allowed to pass from a first chamber to a second chamber, or combinations thereof), thereby allowing the sleeve 32 to transition to the second position. Additionally, in an embodiment, the injection valve 16 may be further configured such that when a second valve 44 is actuated, an additional amount of supportive fluid 63 is drained, thereby allowing the sleeve 32 to be further displaced (e.g., from the second position). For example, in the embodiment of FIG. 9, displacing the sleeve 32 further may transition the sleeve 32 out of the second position thereby disallow fluid communication between the flow passage 36 of the injector valve 16 and the exterior of the injector valve 16 via the openings 28.

In an additional or alternative embodiment, the actuator 50 may be configured to actuate multiple injection valves (e.g., two or more of injection valve 16*a-e*). For example, in an embodiment, the actuator 50 may be configured to actuate multiple ones of the RAPIDFRAC™ Sleeve marketed by Halliburton Energy Services, Inc. of Houston, Tex. USA. In such an embodiment, the actuator 50 may be configured to initiate metering of a hydraulic fluid in the RAPIDFRAC™ Sleeves in response to a predetermined quantity of magnetic signals from signal members moving in a particular direction, as will be disclosed herein, for example, such that a plurality of the injection valves open after a certain period of time.

Figure 11:
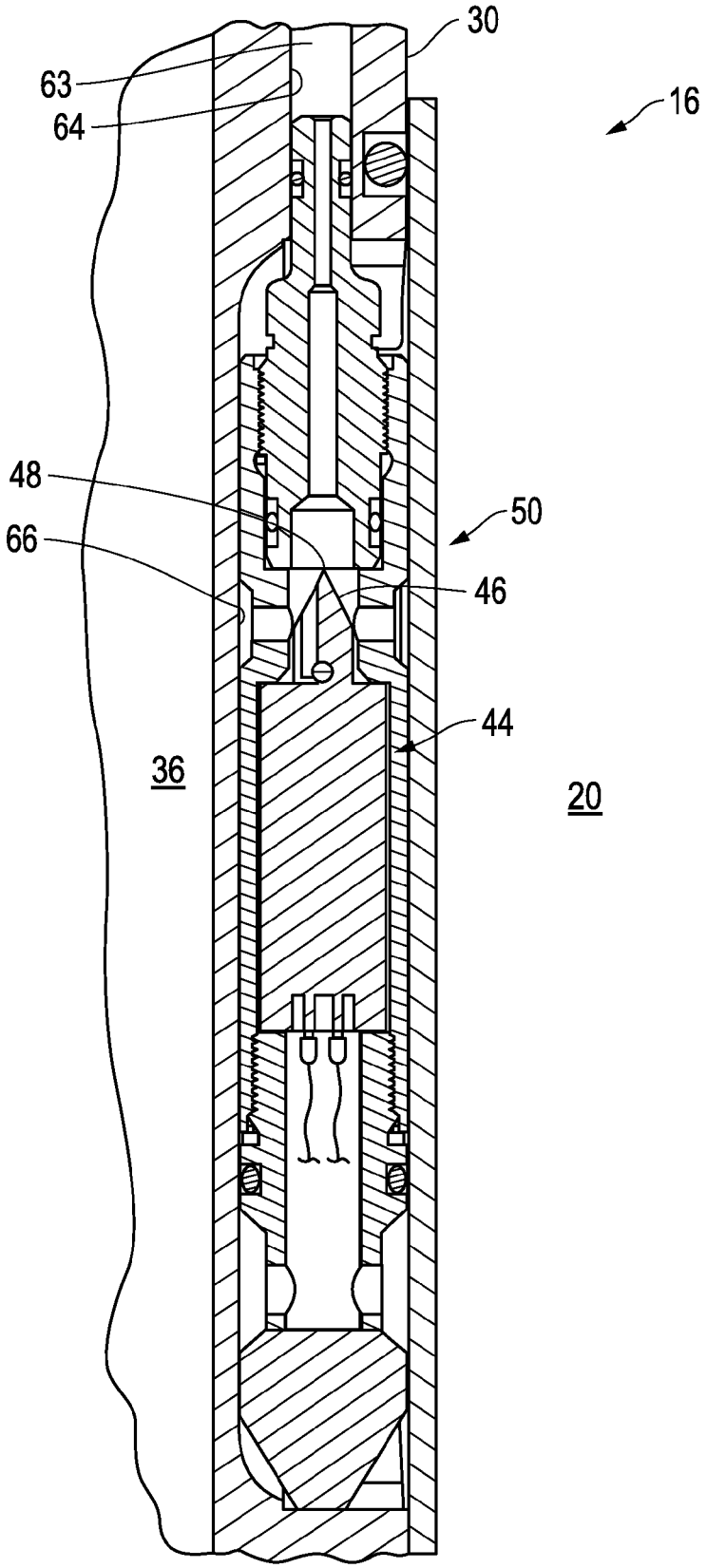
FIG. 11 is an enlarged scale representative cross-sectional view of a valve device which may be used in the injection valve.

In the embodiments of FIGS. 3-6, the injection valve 16 may further comprise one or more chambers (e.g., a chamber 64 and a chamber 66). In such embodiment, one or more of chambers may selectively retain a supportive fluid (e.g., an incompressible fluid), for example, for the purpose of retaining the sleeve 32 in the first position. For example, in the embodiment illustrated in FIG. 11, the injection valve 16 may be configured such that initially the chamber 66 contains air or an inert gas at about or near atmospheric pressure and the chamber 64 contains a supportive fluid 63. Additionally, in an embodiment, the chambers (e.g., the chamber 64 and the chamber 66) may be configured to be initially isolated from each other, for example, via a pressure barrier 48, as illustrated in FIG. 11. In an embodiment, the pressure barrier 48 may be configured to be opened and/or actuated (e.g., shattered, broken, pierced, or otherwise caused to lose structural integrity) in response to the injection valve 16 experiencing a predetermined quantity of magnetic signals from signaling members moving in a particular direction, as will be disclosed herein. For example, in an embodiment, the actuator 50 may comprise a piercing member (e.g., piercing member 46) and may be configured to pierce the pressure barrier 48 in response to the injection valve 16 experiencing the predetermined quantity of magnetic signals, thereby allowing a route of fluid communication between the chambers 64 and 66.

Figure 10A:
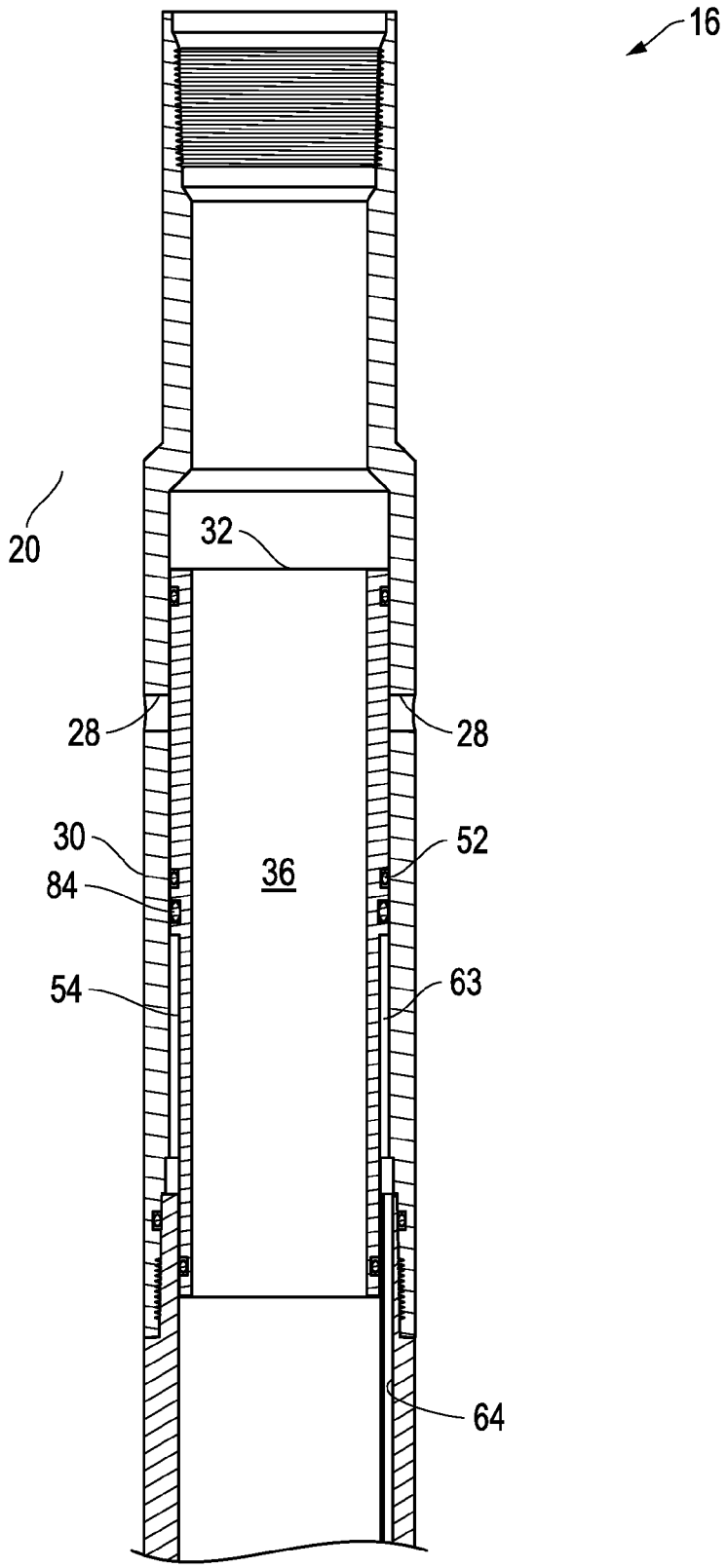
FIGS. 10A & B are representative cross-sectional views of successive axial sections of another example of the injection valve, in a closed configuration.
Figure 10B:
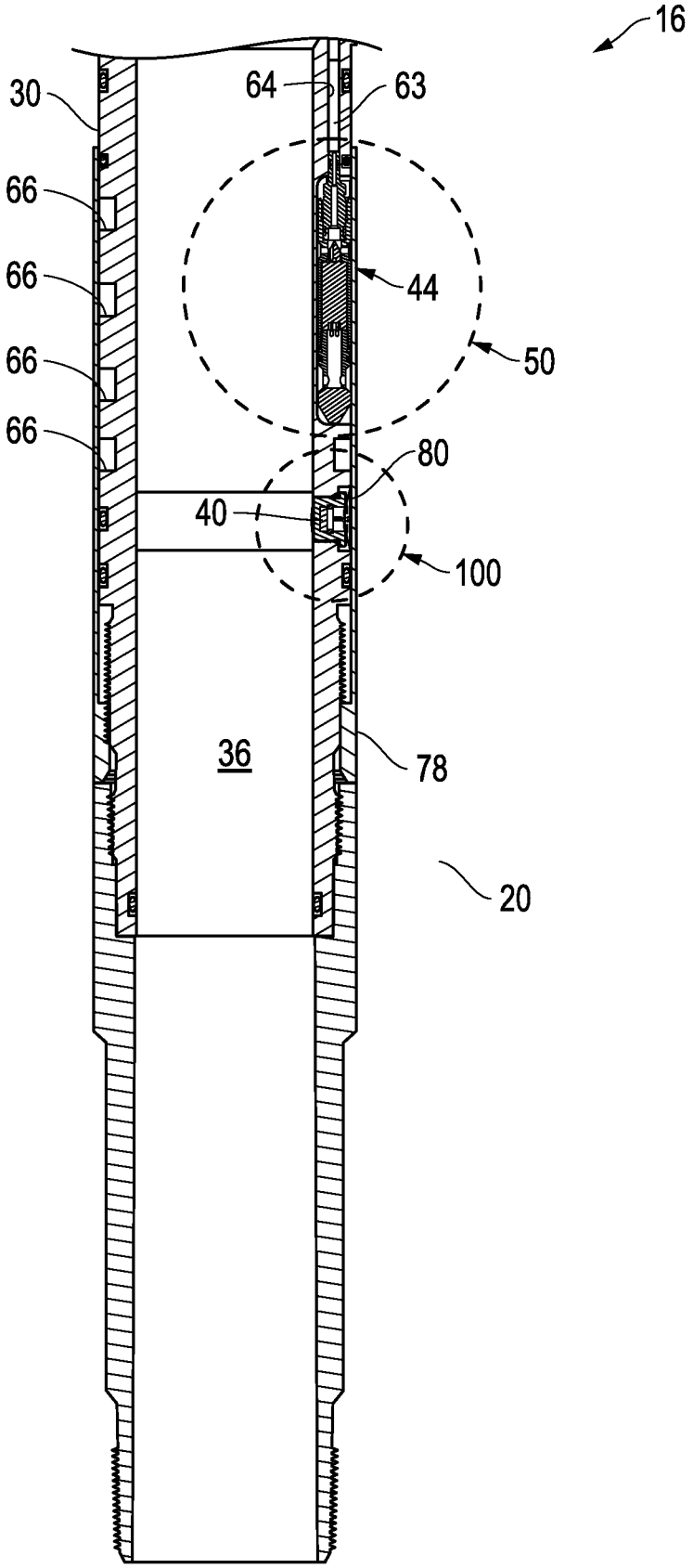

In the embodiment of FIGS. 10A-10B, the injector valve 16 may further comprise a second sleeve 78, such that the second sleeve 78 is configured to isolate the one or more chambers 66 from well fluid in the annulus 20.

In an embodiment, the injection valve 16 may be configured, as previously disclosed, so as to allow fluid to selectively be emitted therefrom, for example, in response to sensing and/or experiencing a predetermined quantity of magnetic signals from signaling members moving in a particular direction. In an embodiment, the injection valve 16 may be configured to actuate upon experiencing a predetermined quantity of magnetic signals from signaling members moving in a particular direction, for example, as may be detected via the DMSAA 100, thereby providing a route of fluid communication to/from the flow passage 36 of the injection valve 16 via the ports (e.g., the openings 28).

As used herein, the term "magnetic signal" refers to an identifiable function of one or more magnetic characteristics and/or properties (for example, with respect to time), for example, as may be experienced at one or more locations within the flow passage (such as flow passage 36) of a wellbore servicing system and/or well tool (such as the wellbore servicing system 10 and/or the injection valve 16) so as to be detected by the well tool or component thereof (e.g., by the DMSAA 100). As will be disclosed herein, the magnetic signal may be effective to elicit a response from the well tool, such as to "wake" one or more components of the DMSAA 100, to actuate (and/or cause actuation of) the actuator 50 as will be disclosed herein, or combinations thereof. In an embodiment, the magnetic signal may be characterized as comprising any suitable type and/or configuration of magnetic field variations, for example, any suitable waveform or combination of waveforms, having any suitable characteristics or combinations of characteristics.

In an embodiment, the magnetic signal may be characterized as a generic magnetic signal. For example, in such an embodiment, the magnetic signal may comprise the presence or absence of a magnetic field (e.g., an induced magnetic field). Alternatively, in an embodiment a magnetic signal may be distinguishable from another magnetic signal. For example, a first magnetic signal may be distinct (e.g., have at least one characteristic that is identifiably different from) a second magnetic field. In such an embodiment, the magnetic signal may comprise a predetermined magnetic signal that is particularly associated with (e.g., recognized by) one or more valves 16. Suitable examples of such a predetermined magnetic signal are disclosed in U.S. application Ser. No. 13/781,093 to Walton et al., and entitled "Method and Apparatus for Magnetic Pulse Signature Actuation," which is incorporated herein in its entirety.

Figure 7:
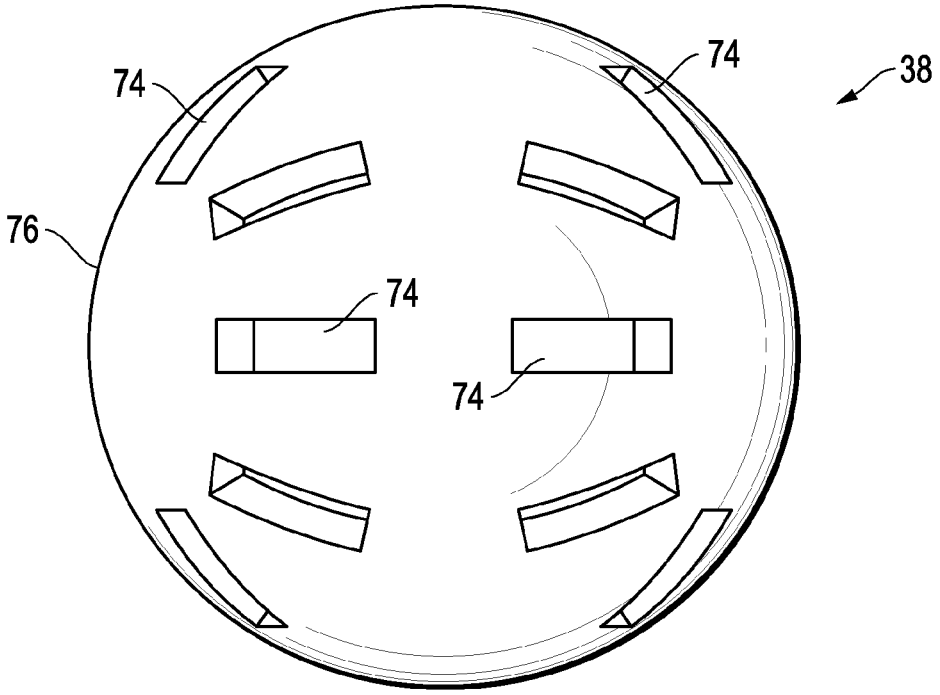
FIGS. 7 & 8 are representative top and side views, respectively, of a magnetic device which may be used with the injection valve.
Figure 8:
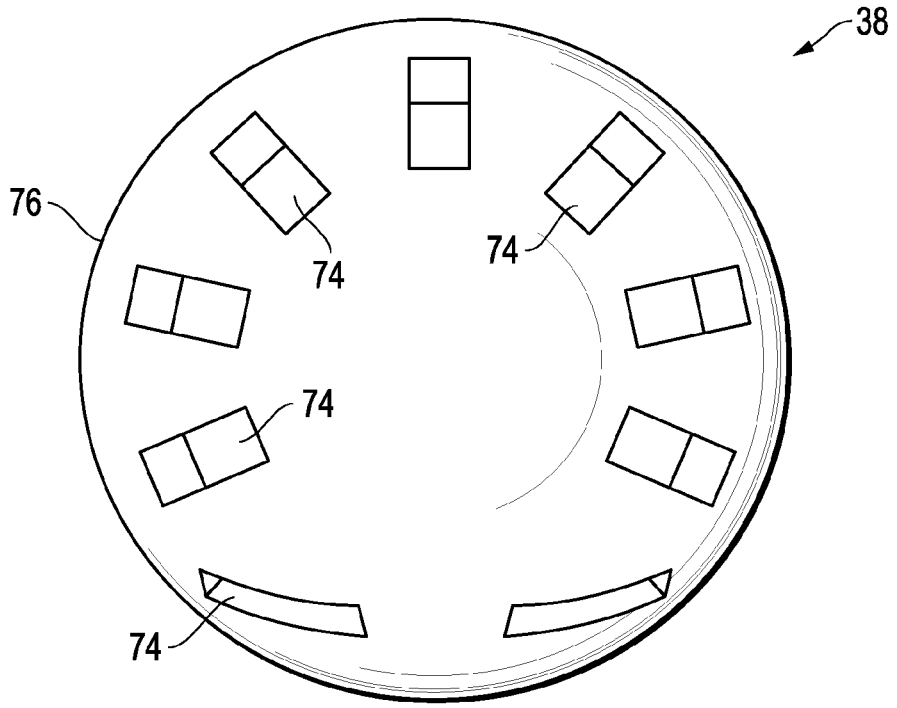

In an embodiment, the magnetic signal may be generated by or formed within a signaling member (e.g., well tool or other apparatus disposed within a flow passage), for example, the magnetic signal may be generated by a magnetic device 38 (e.g., a ball, a dart, a bullet, a plug, etc.) which may be communicated through the flow passage 36 of the injection valve 16. For example, in the embodiments of FIGS. 7-8, the magnetic device 38 may be spherical 76 and may comprise one or more recesses 74. In the embodiments of FIGS. 15A-15B and 16A-16B, the magnetic device 38 (e.g., a ball) may be configured to be communicated/transmitted through the flow passage of the well tool and/or flow passage 36 of the injection valve 16. Also, the magnetic device 38 is configured to emit or radiate a magnetic field (which may comprise the magnetic signal) so as to allow the magnetic field to interact with the injection valve 16 (e.g., the DMSAA 100 of one or injection valves, such as injection valve 16*a-e*), as will be disclosed herein. In an additional or alternative embodiment, the magnetic signal may be generated by one or more tools coupled to a tubular, such as a work string and/or suspended within the wellbore via a wireline.

In an embodiment, the magnetic device 38 may generally comprise a permanent magnet, a direct current (DC) magnet, an electromagnet, or any combination thereof. In an embodiment, the magnetic device 38 or a portion thereof may be made of a ferromagnetic material (e.g., a material susceptible to a magnetic field), such as, iron, cobalt, nickel, steel, rare-earth metal alloys, ceramic magnets, nickel-iron alloys, rare-earth magnets (e.g., a Neodymium magnet, a Samarium-cobalt magnet), other known materials such as Co-netic AA®, Mumetal®, Hipernon®, Hy-Mu-80®, Permalloy® (which all may comprise about 80% nickel, 15% iron, with the balance being copper, molybdenum, chromium), any other suitable material as would be appreciated by one of ordinary skill in the art upon viewing this disclosure, or combinations thereof. For example, in an embodiment, the magnetic device 38 may comprise a magnet, for example, a ceramic magnet or a rare-earth magnet (e.g., a neodymium magnet or a samarium-cobalt magnet). In such an embodiment, the magnetic device 38 may comprise a surface having a magnetic north-pole polarity and a surface having magnetic south-pole polarity and may be configured to generate a magnetic field, for example, the magnetic signal.

In an additional or alternative embodiment, the magnetic device 38 may further comprise an electromagnet comprising an electronic circuit comprising a current source (e.g., current from one or more batteries, a wire line, etc.), an insulated electrical coil (e.g., an insulated copper wire with a plurality of turns arranged side-by-side), a ferromagnetic core (e.g., an iron rod), and/or any other suitable electrical or magnetic components as would be appreciated by one of ordinary skill in the arts upon viewing this disclosure, or combinations thereof. In an embodiment, the electromagnet may be configured to provide an adjustable and/or variable magnetic polarity. Additionally, in an embodiment the magnetic device 38 (which comprises the magnet and/or electromagnet) may be configured to engage one or more injection valves 16 and/or to not engage one or more other injection valves 16.

Not intending to be bound by theory, according to Ampere's Circuital Law, such an insulated electric coil may produce a temporary magnetic field while an electric current flows through it and may stop emitting the magnetic field when the current stops. Additionally, application of a direct current (DC) to the electric coil may form a magnetic field of constant polarity and reversal of the direction of the current flow may reverse the magnetic polarity of the magnetic field. In an embodiment, the magnetic device 38 may comprise an insulated electrical coil electrically connected to an electronic circuit (e.g., via a current source), thereby forming an electromagnet or a DC magnet. In an additional embodiment, the electronic circuit may be configured to provide an alternating and/or a varying current, for example, for the purpose of providing an alternating and/or varying magnetic field. Additionally, in such an embodiment, a metal core may be disposed within the electrical coil, thereby increasing the magnetic flux (e.g., magnetic field) of the electromagnet.

Figure 15A:
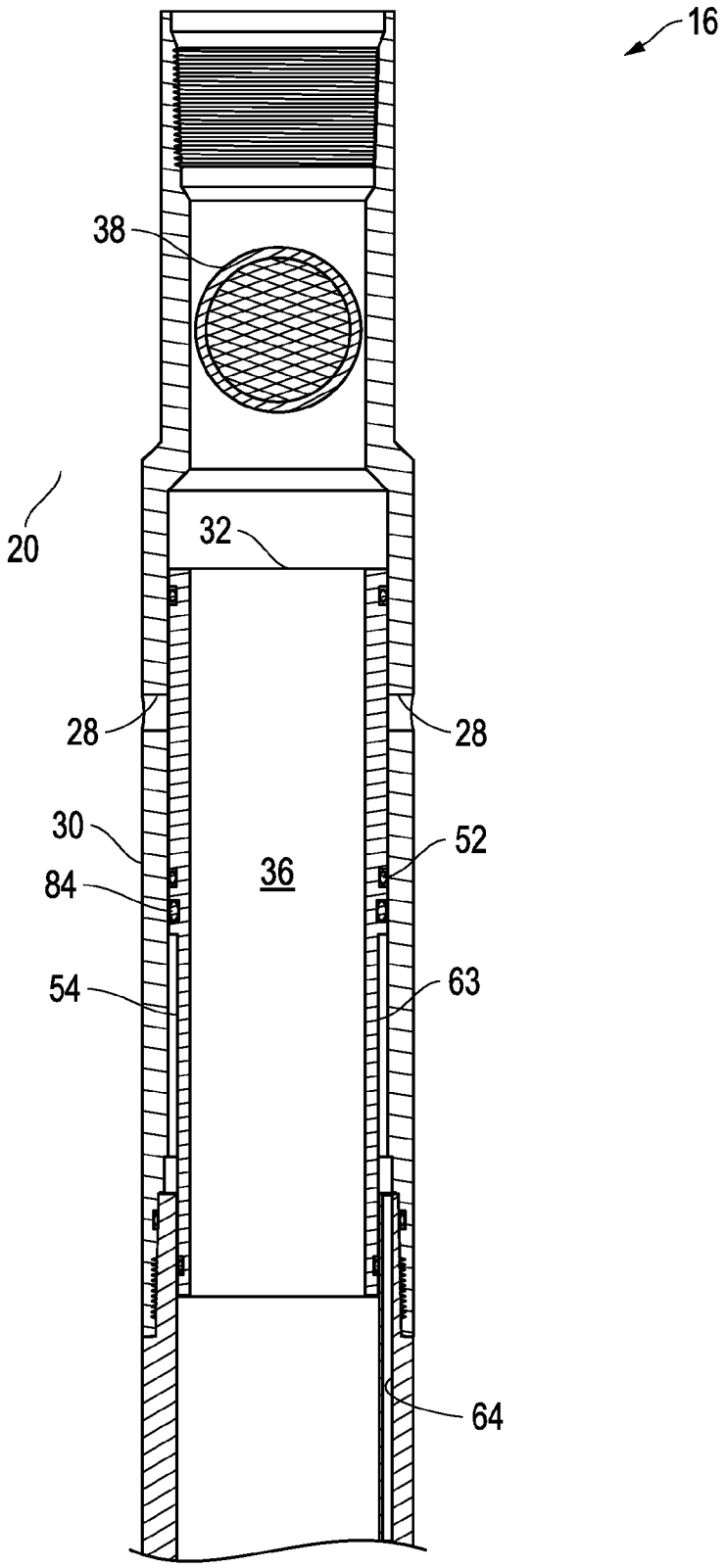
FIGS. 15A & B are representative cross-sectional views of another example of an injection valve in a first configuration.
Figure 15B:
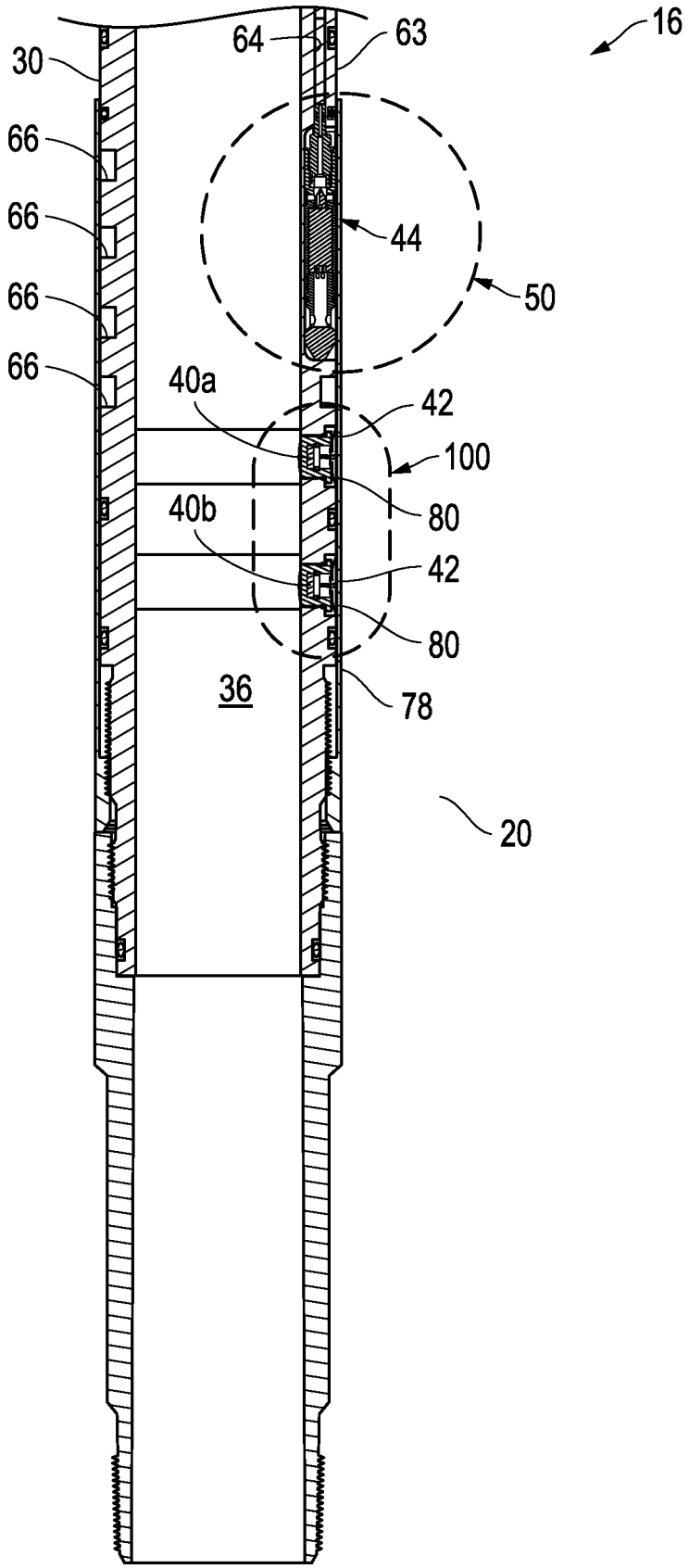
Figure 16A:
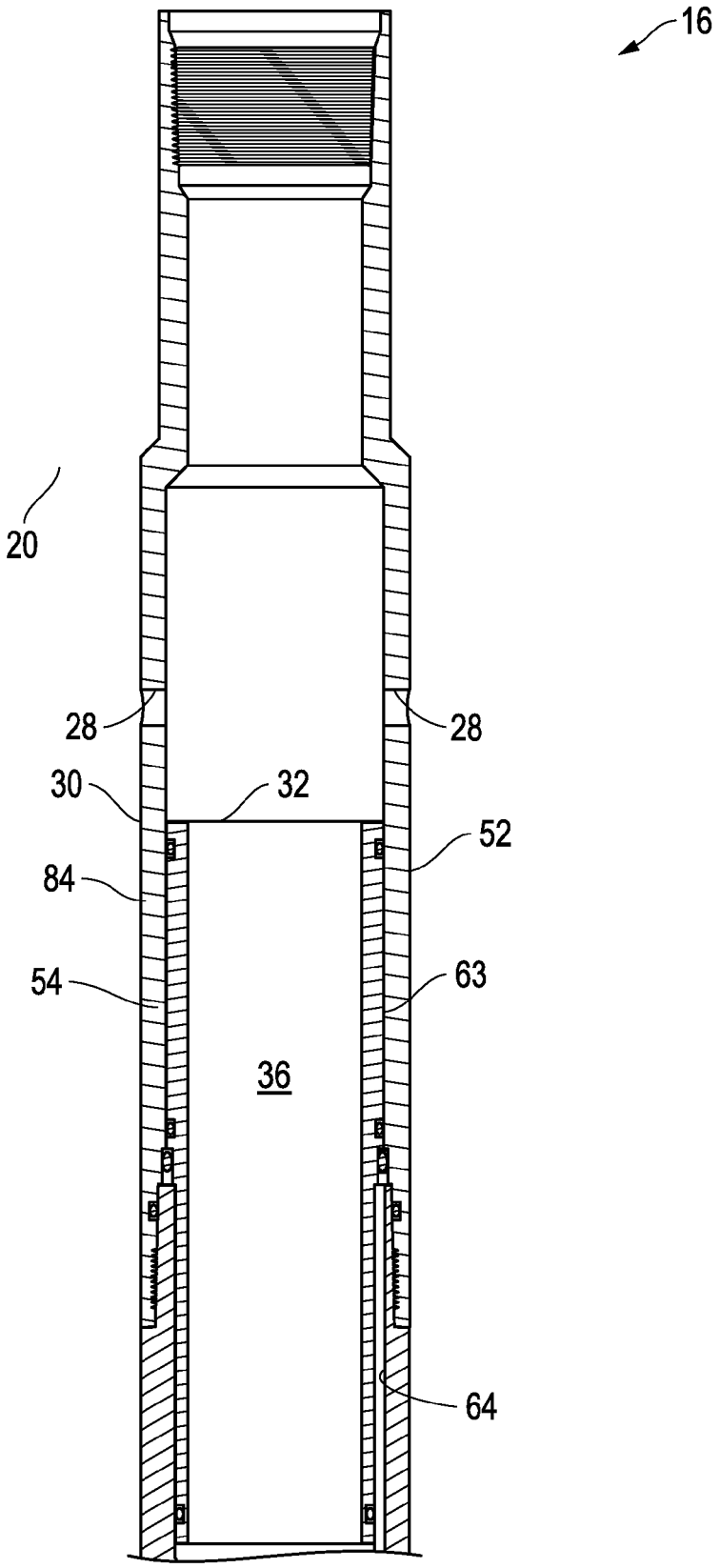
FIGS. 16A & B are representative cross-sectional views of another example of an injection valve in a second configuration.
Figure 16B:
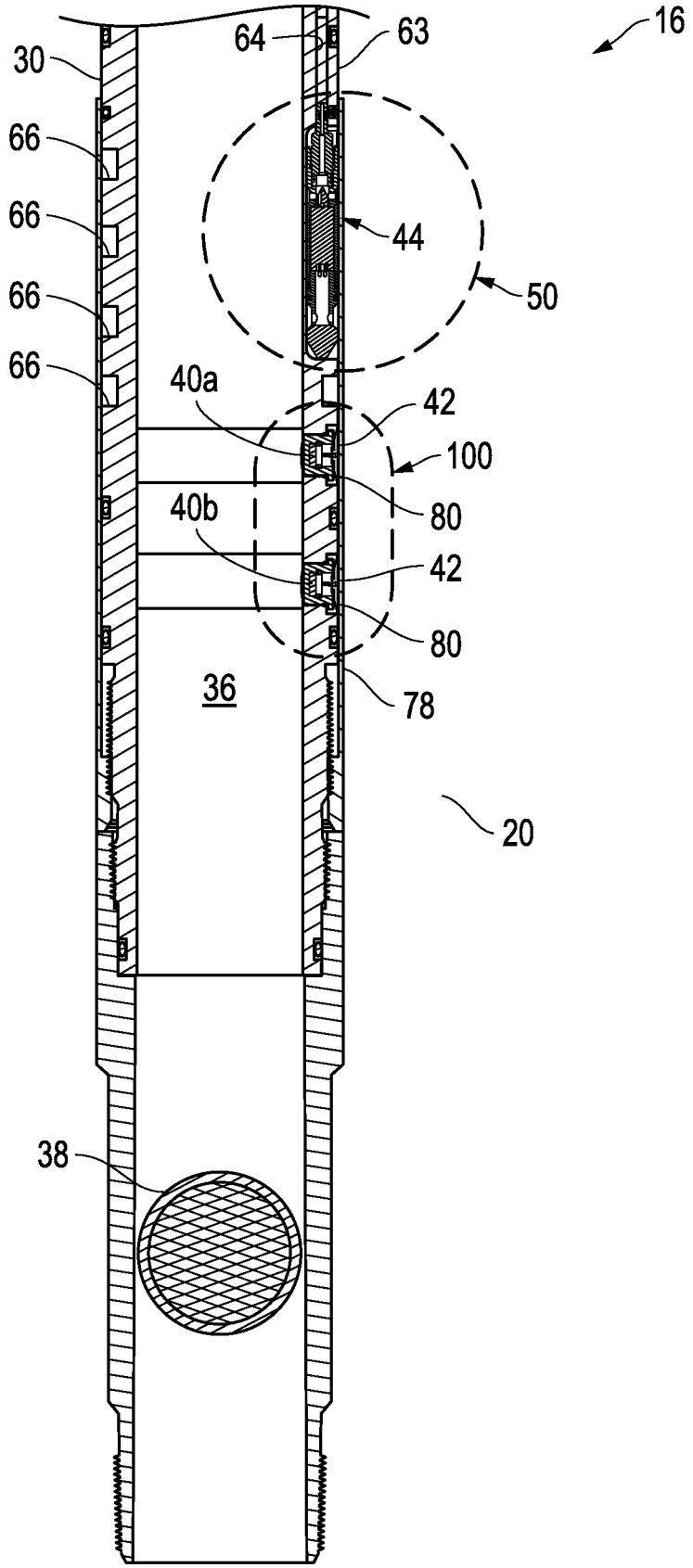

In an embodiment, the DMSAA 100 generally comprises a plurality (e.g., a pair) of magnetic sensors 40 and an electronic circuit 42, as illustrated in FIGS. 15B and 16B. For example, in the embodiment of FIGS. 15B and 16B, the injection valve 16 comprises a first magnetic sensor 40*a* and a second magnetic sensor 40*b*. In an embodiment, the magnetic sensors 40 and/or the electronic circuit 42 may be fully or partially incorporated within the injection valve 16 by any suitable means as would be appreciated by one of ordinary skill in the art upon viewing this disclosure. For example, in an embodiment, the magnetic sensors 40 and/or the electronic circuit 42 may be housed, individually or separately, within a recess within the housing 30 of the injection valve 16. In an alternative embodiment, as will be appreciated by one of ordinary skill in the art, at least a portion of the magnetic sensors 40 and/or the electronic circuit 42 may be otherwise positioned, for example, external to the housing 30 of the injection valve 16. It is noted that the scope of this disclosure is not limited to any particular configuration or position of magnetic sensors 40 and/or electronic circuits 42. For example, although the embodiments of FIGS. 15B and 16B illustrate a DMSAA 100 comprising multiple distributed components (e.g., individual magnetic sensors 40 and a single electronic circuit 42), in an alternative embodiment, a similar DMSAA may comprise similar components in a single, unitary component; alternatively, the functions performed by these components (e.g., the magnetic sensors 40 and the electronic circuit 42) may be distributed across any suitable number and/or configuration of like componentry, as will be appreciated by one of ordinary skill in the art upon viewing this disclosure.

In an embodiment, where the magnetic sensors 40 and the electronic circuit 42 comprise distributed components, the electronic circuit 42 may be configured to communicate with the magnetic sensors 40 and/or actuator 50 via a suitable signal conduit, for example, via one or more suitable wires. Examples of suitable wires include, but are not limited to, insulated solid core copper wires, insulated stranded copper wires, unshielded twisted pairs, fiber optic cables, coaxial cables, any other suitable wires as would be appreciated by one of ordinary skill in the art upon viewing this disclosure, or combinations thereof. Additionally, in an embodiment, the electronic circuit 42 may be configured to communicate with the magnetic sensors 40 and/or the actuator 50 via a suitable signaling protocol. Examples of such a signaling protocol include, but are not limited to, an encoded digital signal.

In an embodiment, the magnetic sensor 40 may comprise any suitable type and/or configuration of apparatus capable of detecting a magnetic field (e.g., a particular, predetermined magnetic signal) within a given, predetermined proximity of the magnetic sensor 40 (e.g., within the flow passage 36 of the injection valve 16). Suitable magnetic sensors may include, but are not limited to, a magneto-resistive sensor, a giant magneto-resistive (GMR) sensor, a microelectromechanical systems (MEMS) sensor, a Hall-effect sensor, a conductive coils sensor, a super conductive quantum interference device (SQUID) sensor, or the like. In an additional embodiment, the magnetic sensor 40 may be configured to be combined with one or more permanent magnets, for example, to create a magnetic field that may be disturbed by a magnetic device (e.g., the magnetic device 38).

In an embodiment, the magnetic sensor 40 may be configured to output a suitable indication of a magnetic signal, such as the predetermined magnetic signal. For example, in an embodiment, the magnetic sensor 40 may be configured to convert a magnetic field to a suitable electrical signal. In an embodiment, a suitable electrical signal may comprise a varying analog voltage or current signal representative of a magnetic field and/or a variation in a magnetic field experienced by the magnetic sensor 40. In an alternative embodiment, the suitable electrical signal may comprise a digital encoded voltage signal in response to a magnetic field and/or variation in a magnetic field experienced by the magnetic sensor 40.

Figure 17:
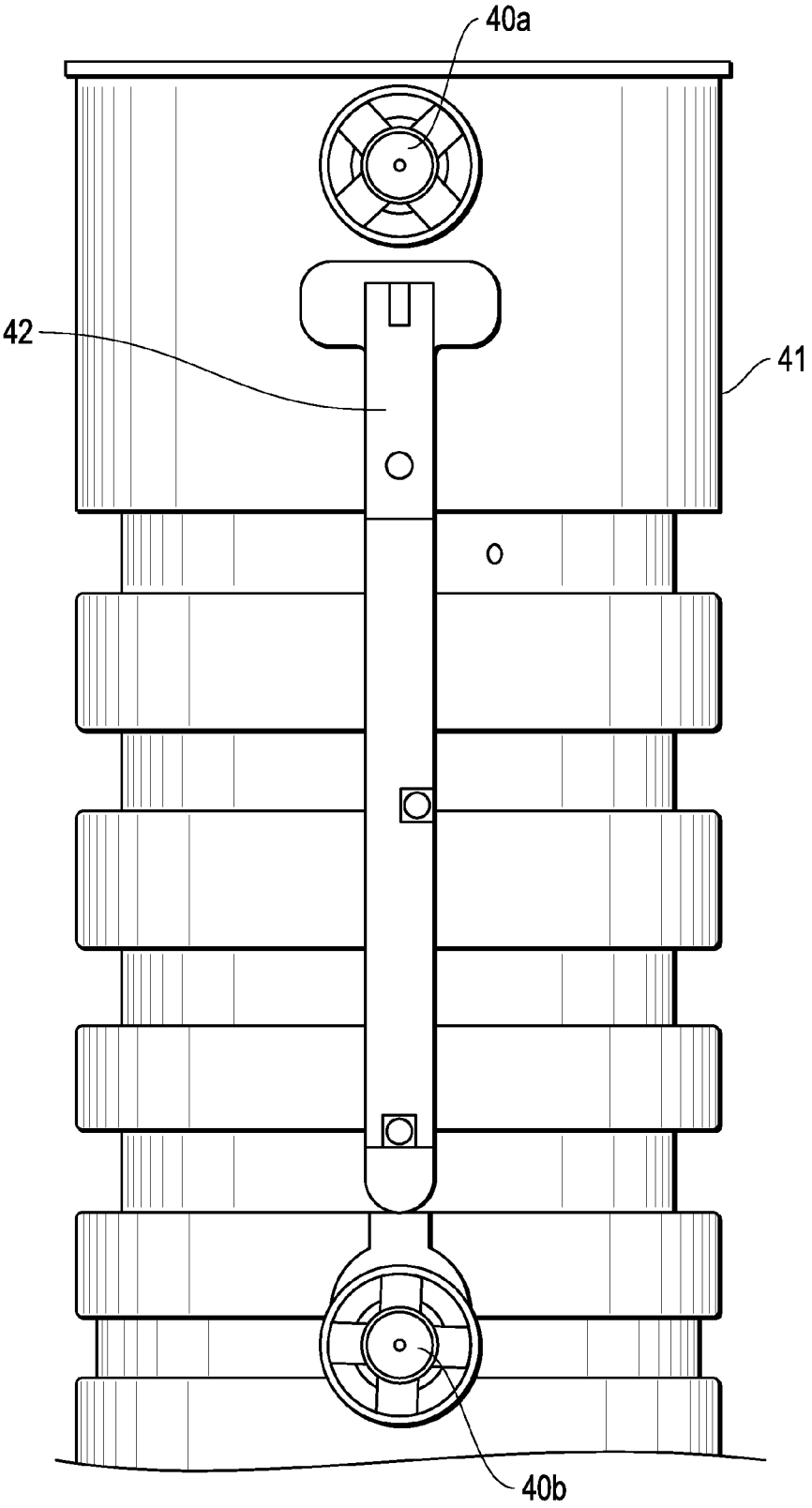
FIG. 17 is an embodiment of a dual magnetic sensor actuation assembly.

In the embodiment of FIG. 17, the plurality of magnetic sensors 40 comprises a first magnetic sensor 40*a* and a second magnetic sensor 40*b*. In such an embodiment, the first magnetic sensor 40*a* is positioned up-hole relative to the second magnetic sensor 40*b*.

In an embodiment, each of the magnetic sensors 40 may be positioned for detecting magnetic fields and/or magnetic field changes in the passage 36. For example, in the embodiment of FIG. 12, a magnetic sensor 40 (e.g., the first magnetic sensor 40*a* and/or the second magnetic sensor 40*b*) is mounted in an insertable unit, such as a plug 80 which may be secured within the housing 30 in a suitably close proximity to the passage 36. Alternatively, in the embodiment of FIG. 17, the magnetic sensors 40 (e.g., the first magnetic sensor 40*a* and the second magnetic sensor 40*b*) are mounted within a sensor housing 41. In such an embodiment, the magnetic sensors 40 may be positioned and/or spaced a fixed distance apart (e.g., longitudinally, along the length of the injection valve 16) from each other. For example, in an embodiment the magnetic sensors (e.g., the first magnetic sensor 40*a* and the second magnetic sensor) may be spaced at least about 6 inches, alternatively, at least about 12 inches, alternatively at least about 2 feet, alternatively, at least about 3 feet, alternatively, at least about 4 feet, alternatively, at least about 5 feet, alternatively, at least about 6 feet, alternatively, about 10 feet, alternatively, any suitable distance. In an embodiment, the spacing between the magnetic sensors may be configured dependent upon one or more of the parameters associated with the intended operation of the valve, for example, the speed of a signaling member.

Figure 12:
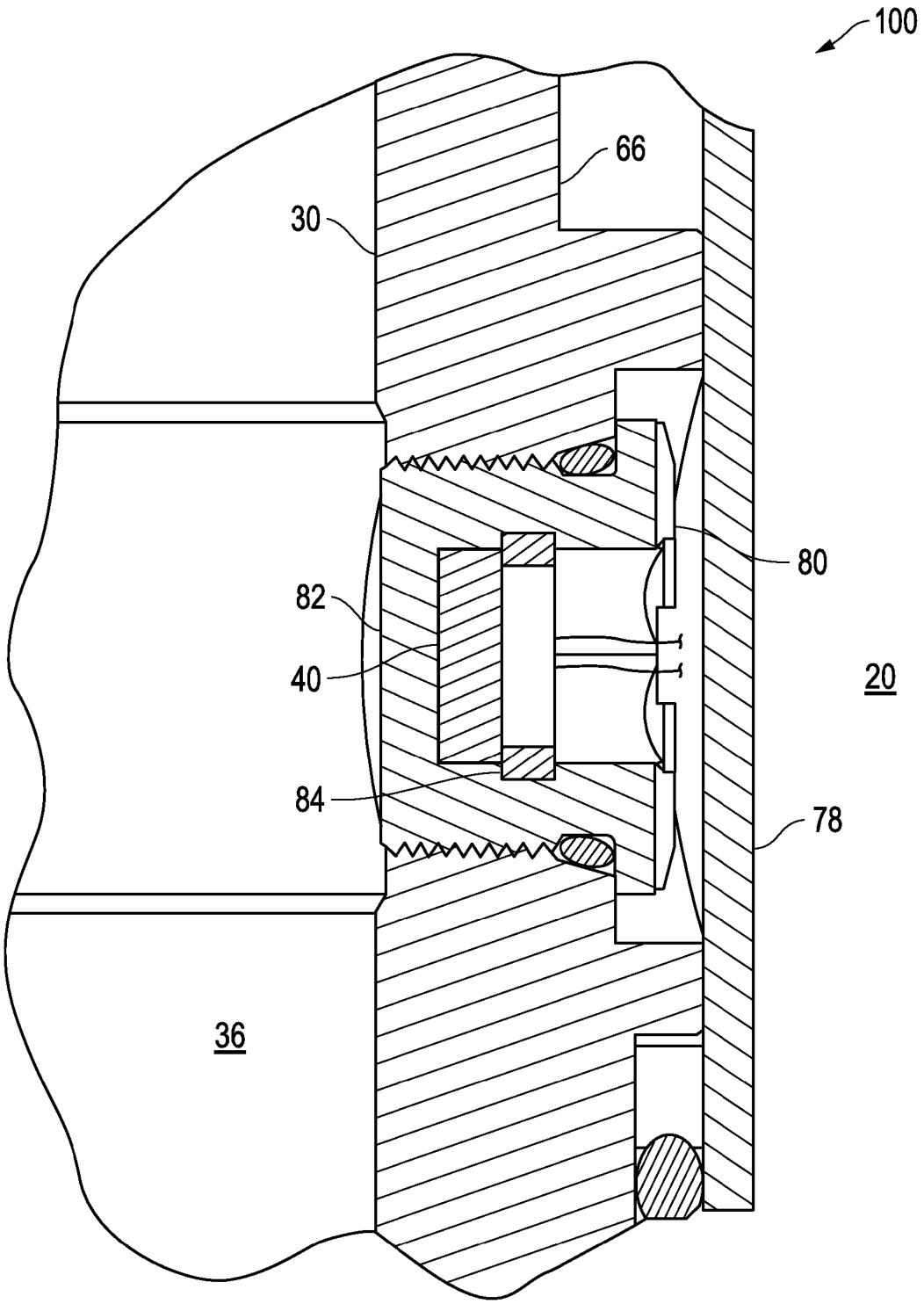
FIG. 12 is an enlarged scale representative cross-sectional view of a magnetic sensor assembly which may be used in the injection valve.

Referring to the embodiment of FIG. 12, the magnetic sensors 40 may be separated from the flow passage 36 by a pressure barrier 82 having a relatively low magnetic permeability (e.g., having a relatively low tendency to support the formation of a magnetic field). In an embodiment, the pressure barrier 82 may be integrally formed as part of the plug 80. In an alternative embodiment, the pressure barrier could be a separate element.

Suitable low magnetic permeability materials for the pressure barrier 82 can include Inconel and other high nickel and chromium content alloys, stainless steels (such as, 300 series stainless steels, duplex stainless steels, etc.). Inconel alloys have magnetic permeabilities of about $1\times10^{-6}$, for example. Aluminum (e.g., magnetic permeability $\sim1.26\times10^{-6}$), plastics, composites (e.g., with carbon fiber, etc.) and other non-magnetic materials may also be used.

Not intending to be bound by theory, an advantage of making the pressure barrier 82 out of a low magnetic permeability material is that the housing 30 can be made of a relatively low cost high magnetic permeability material (such as steel, having a magnetic permeability of about $9\times10^{-4}$, for example), but magnetic fields produced by the magnetic device 38 in the passage 36 can be detected by the magnetic sensors 40 through the pressure barrier 82. That is, magnetic flux (e.g., the magnetic field) can readily pass through the relatively low magnetic permeability pressure barrier 82 without being significantly distorted.

In some examples, a relatively high magnetic permeability material 84 may be provided proximate the magnetic sensors 40 and/or pressure barrier 82, for example, in order to focus the magnetic flux on the magnetic sensors 40. For example, a permanent magnet could also be used to bias the magnetic flux, for example, so that the magnetic flux is within a linear range of detection of the magnetic sensors 40.

In some examples, the relatively high magnetic permeability material 84 surrounding the magnetic sensor 40 can block or shield the magnetic sensor 40 from other magnetic fields, such as, due to magnetism in the earth surrounding the wellbore 14. For example, the material 84 allows only a focused window for magnetic fields to pass through, and only from a desired direction. Not intending to be bound by theory, this has the benefit of preventing other undesired magnetic fields from contributing to the magnetic field experienced by the magnetic sensor 40 and, thereby, the output therefrom.

Figure 13:
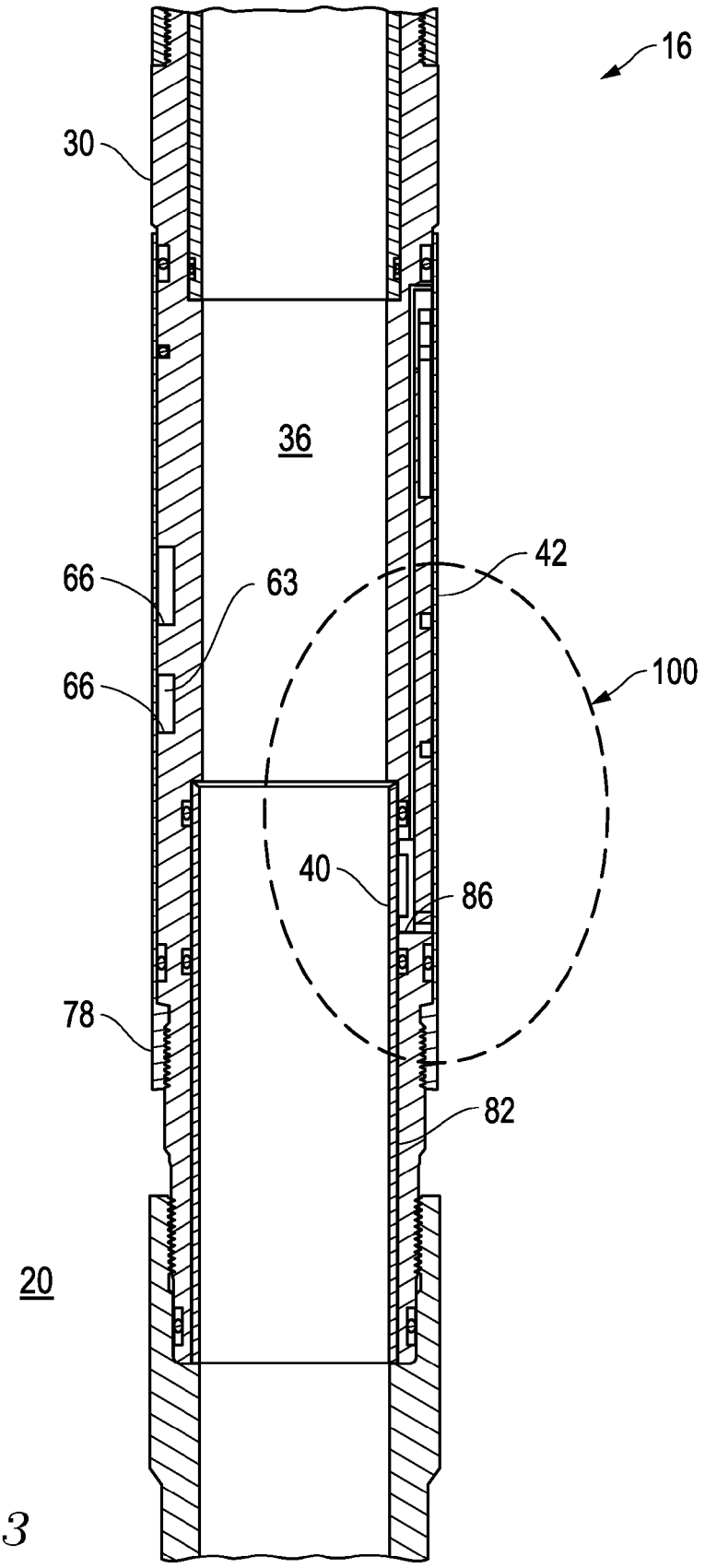
FIG. 13 is a representative cross-sectional view of another example of the injection valve.
Figure 14:
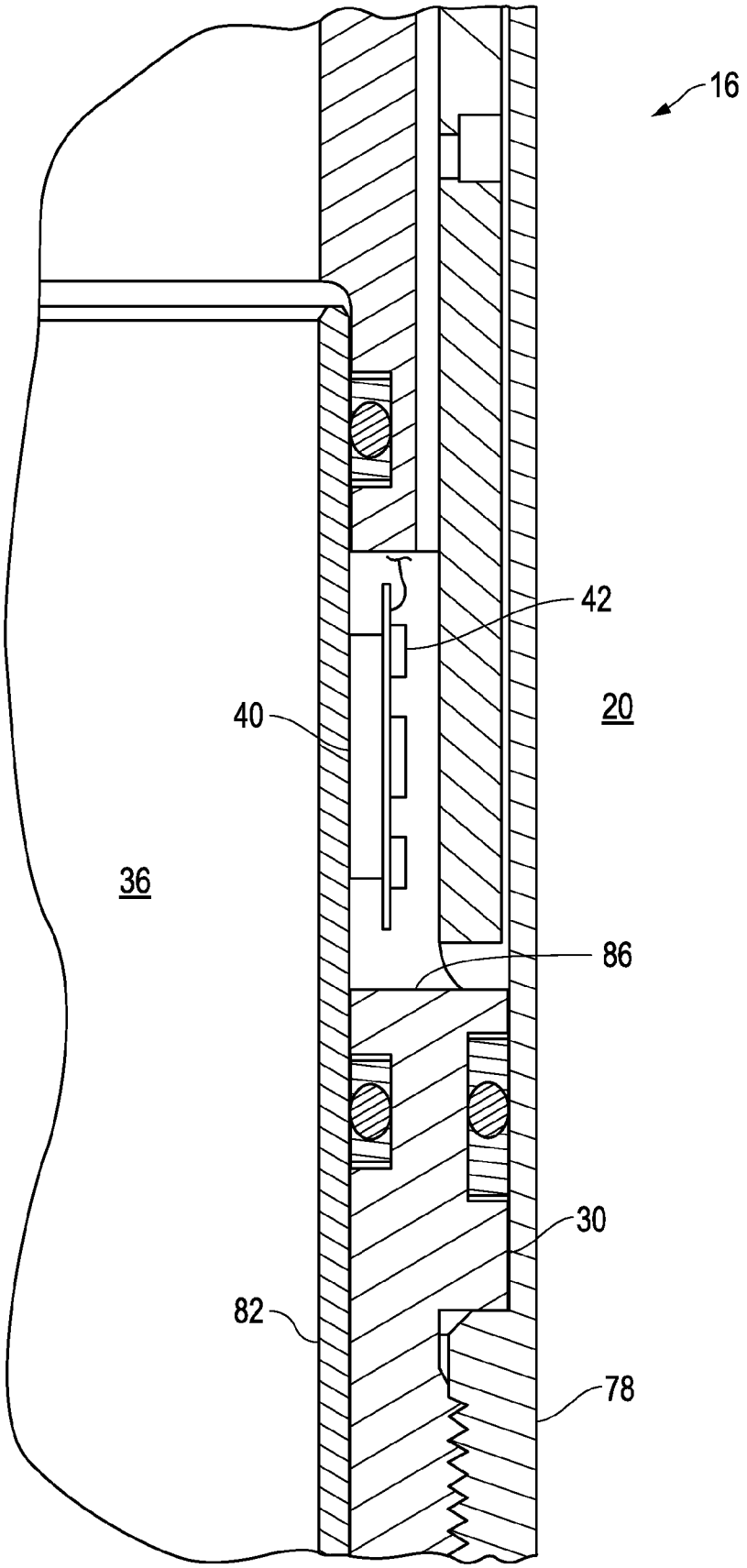
FIG. 14 is an enlarged scale representative cross-sectional view of another example of the magnetic sensor in the injection valve of FIG. 13.

Referring now to FIGS. 13 and 14, the pressure barrier 82 is in the form of a sleeve received in the housing 30. Additionally, in such an embodiment, the magnetic sensor 40 is disposed in an opening 86 formed within the housing 30, such that the magnetic sensor 40 is in close proximity to the passage 36, and is separated from the passage only by the relatively low magnetic permeability pressure barrier 82. In such an embodiment, the magnetic sensor 40 may be mounted directly to an outer cylindrical surface of the pressure barrier 82.

In the embodiment of FIG. 14, an enlarged scale view of a magnetic sensor 40 (e.g., the first magnetic sensor 40*a* or the second magnetic sensor 40*b*) is depicted. In this example, the magnetic sensor 40 is mounted with a portion of the electronic circuitry 42 in the opening 86. For example, in such an embodiment, one or more of the magnetic sensors 40 could be mounted to a small circuit board with hybrid electronics thereon.

In an embodiment, the magnetic sensors 40 (e.g., the first magnetic sensor 40*a* or the second magnetic sensor 40*b*) may be employed, for example, for one or more of the purposes of implementing an actuation algorithm, error checking, redundancy testing, and/or any other suitable uses as would be appreciated by one of ordinary skill in the art upon viewing this disclosure when detecting a magnetic signal. For example, in an embodiment, the magnetic sensors 40 may be employed to determine the number of magnetic devices 38 within the flow passage 36 and/or the flow direction of travel/movement of the one or more magnetic devices 38, as will be disclosed herein. In an additional embodiment, the magnetic sensors 40 can be employed to detect the magnetic field(s) in an axial, radial or circumferential direction. Detecting the magnetic field(s) in multiple directions can increase confidence that the magnetic signal will be detected regardless of orientation. Thus, it should be understood that the scope of this disclosure is not limited to any particular positioning of the magnetic sensors 40.

In an embodiment, the electronic circuit 42 may be generally configured to receive an electrical signal from the magnetic sensors 40, for example, so as to determine if variations in the magnetic field detected by the magnetic sensors 40 are indicative of a magnetic signal (e.g., a generic magnetic signal or a predetermined magnetic signal), to determine the direction of travel of a signaling member (e.g., a magnetic device) emitting the magnetic, and to determine the quantity of magnetic signals from signaling members moving in a particular direction. In an embodiment, upon a determination that the magnetic sensors 40 have experienced a predetermined quantity of magnetic signals from signaling members moving in a particular direction, the electronic circuit 42 may be configured to output one or more suitable responses. For example, in an embodiment, in response to recognizing a predetermined magnetic pulse signature, the electronic circuit 42 may be configured to wake (e.g., to enter an active mode), to sleep (e.g., to enter a lower power-consumption mode), to output an actuation signal to the actuator 50 or combinations thereof. In an embodiment, the electronic circuit 42 may be preprogrammed (e.g., prior to being disposed within the injection valve 16 and/or wellbore 14) to be responsive to a particular magnetic signal and/or a particular quantity of magnetic signals. In an additional or alternative embodiment, the electronic circuit 42 may be configured to be programmable (e.g., via a well tool), for example, following being disposed within the injection valve 16.

In an embodiment, the electronic circuit 42 may comprise a plurality of functional units. In an embodiment, a functional unit (e.g., an integrated circuit (IC)) may perform a single function, for example, serving as an amplifier or a buffer. The functional unit may perform multiple functions on a single chip. The functional unit may comprise a group of components (e.g., transistors, resistors, capacitors, diodes, and/or inductors) on an IC which may perform a defined function. The functional unit may comprise a specific set of inputs, a specific set of outputs, and an interface (e.g., an electrical interface, a logical interface, and/or other interfaces) with other functional units of the IC and/or with external components. In some embodiments, the functional unit may comprise repeat instances of a single function (e.g., multiple flip-flops or adders on a single chip) or may comprise two or more different types of functional units which may together provide the functional unit with its overall functionality. For example, a microprocessor or a microcontroller may comprise functional units such as an arithmetic logic unit (ALU), one or more floating-point units (FPU), one or more load or store units, one or more branch prediction units, one or more memory controllers, and other such modules. In some embodiments, the functional unit may be further subdivided into component functional units. A microprocessor or a microcontroller as a whole may be viewed as a functional unit of an IC, for example, if the microprocessor shares a circuit with at least one other functional unit (e.g., a cache memory unit).

The functional units may comprise, for example, a general purpose processor, a mathematical processor, a state machine, a digital signal processor (DSP), a receiver, a transmitter, a transceiver, a logic unit, a logic element, a multiplexer, a demultiplexer, a switching unit, a switching element an input/output (I/O) element, a peripheral controller, a bus, a bus controller, a register, a combinatorial logic element, a storage unit, a programmable logic device, a memory unit, a neural network, a sensing circuit, a control circuit, an analog to digital converter (ADC), a digital to analog converter (DAC), an oscillator, a memory, a filter, an amplifier, a mixer, a modulator, a demodulator, and/or any other suitable devices as would be appreciated by one of ordinary skill in the art.

In the embodiments of FIGS. 15A-15B and 16A-16B, the electronic circuit 42 may comprise a plurality of distributed components and/or functional units and each functional unit may communicate with one or more other functional units via a suitable signal conduit, for example, via one or more electrical connections, as will be disclosed herein. In an alternative embodiment, the electronic circuit 42 may comprise a single, unitary, or non-distributed component capable of performing the function disclosed herein. Additionally, in an embodiment, as depicted in FIG. 17, the electronic circuit 42 may be positioned within the sensor housing 41, for example, within a groove, slot, or recess of the sensor housing 41.

In an embodiment, the electronic circuit 42 may be configured to sample an electrical signal (e.g., an electrical signal from the magnetic sensors 40) at a suitable rate. For example, in an embodiment, the electronic circuit 42 sample rate may be about 1 Hz, alternatively, about 8 Hz, alternatively, about 12 Hz, alternatively, about 20 Hz, alternatively, about 100 Hz, alternatively, about 1 kHz, alternatively, about 10 kHz, alternatively, about 100 kHz, alternatively, about 1 megahertz (MHz), alternatively, any suitable sample rate as would be appreciated by one of skill in the art. In an embodiment, the sampling rate may be configured dependent upon one or more of the parameters associated with the intended operation of the valve, for example, the speed of a signaling member.

In an embodiment, upon determining that the magnetic sensor 40 has experienced a magnetic signal (e.g., a generic magnetic signal or a predetermined magnetic signal), the electronic circuit 42 may be configured to determine the direction of movement of the signaling member (e.g., the magnetic device 38) emitting the magnetic signal. For example, the electronic circuit 42 may be configured to determine the direction of movement of the magnetic device 38 based upon the signals received from the magnetic sensors 40 (e.g., the first magnetic sensor 40*a* and the second magnetic sensor 40*b*). For example, in such an embodiment, the flow direction of the magnetic device 38 may be determined dependent on which magnetic sensor (e.g., the first magnetic sensor 40*a* and the second magnetic sensor 40*b*) experiences the predetermined magnetic signal first. For example, in an embodiment where the first magnetic sensor 40*a* is positioned up-hole of the second magnetic sensor 40*b*, a magnetic device 38 flowing in a down-hole direction will be first experienced by the first magnetic sensor 40*a* then subsequently by the second magnetic sensor 40*b*. Additionally, in such an embodiment, a magnetic device 38 flowing in an up-hole direction will be first experienced by the second magnetic sensor 40*b* then subsequently by the first magnetic sensor 40*a*. For example, in such an embodiment, the electronic circuit 42 may be configured so as to recognize that receipt of a signal, first from the first sensor 40*a* and second from the second sensor 40*b*, is indicative of downward movement and to recognized recognize that receipt of a signal, first from the second sensor 40*b* and second from the first sensor 40*a*, is indicative of upward movement.

Figure 18:
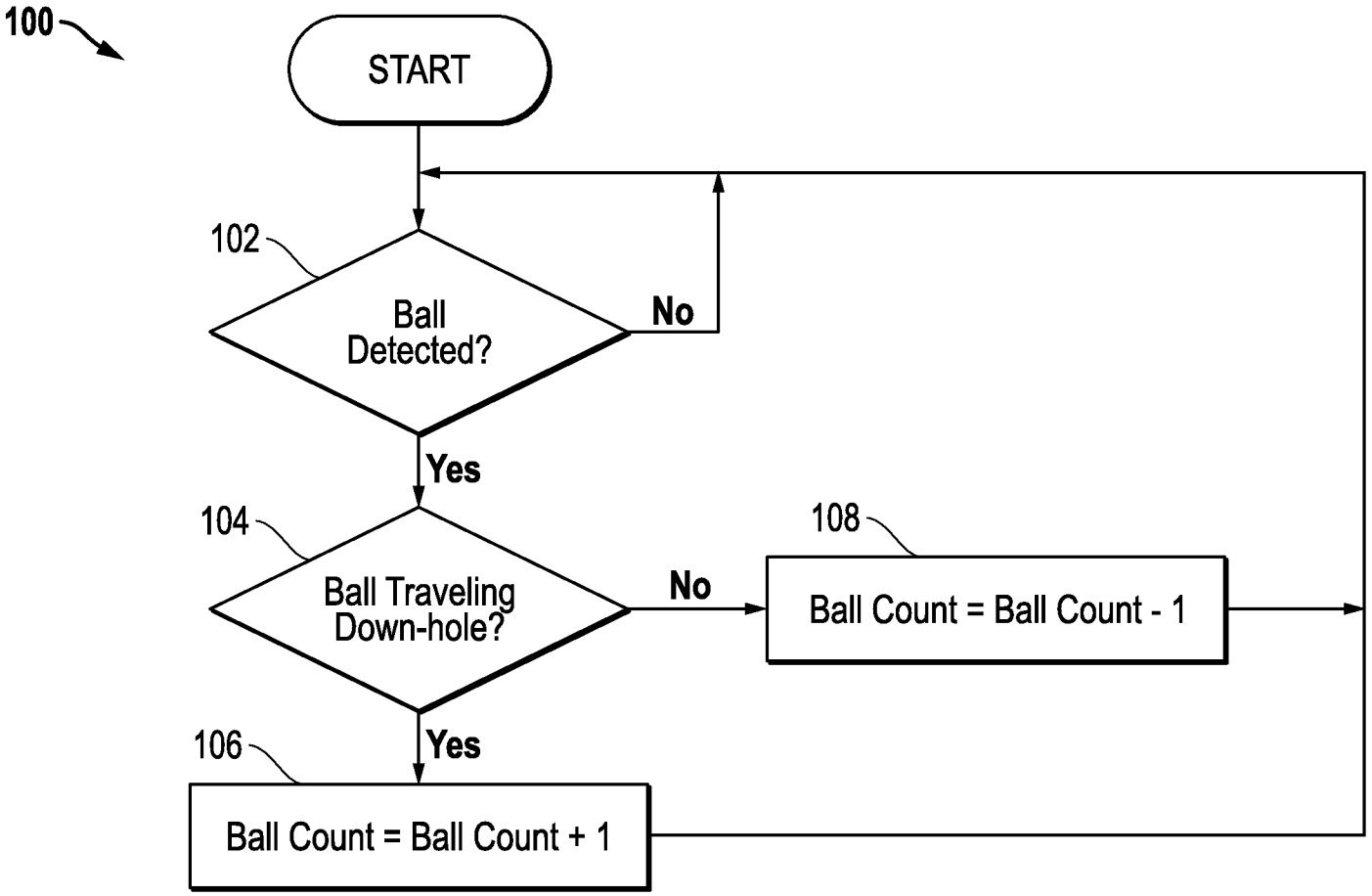
FIG. 18 a flowchart of an embodiment of a magnetic sensor counting algorithm.

In an embodiment, the electronic circuit 42 may be configured to record and/or count the number of magnetic signals (e.g., generic magnetic signals or predetermined magnetic signals) experienced by the magnetic sensors 40, particularly, to record and/or count the number of magnetic devices 38 (e.g., emitting magnetic signals) passing through the valve 16 in a particular direction. In an embodiment, the electronic circuit 42 may be configured to increment and/or decrement a counter (e.g., a digital counter, a program variable stored in a memory device, etc.) in response to experiencing a magnetic signal (e.g., a predetermined magnetic signal) from a magnetic device 38 and based upon the flow direction of the magnetic device 38. Referring to FIG. 18, an example of a logic sequence by which incrementation and/or decrementation may be determined based upon the direction of travel of a magnetic device. For example, in an embodiment, the DMSAA 100 may be configured such that experiencing a magnetic signal from a magnetic device 38 flowing in the down-hole direction (e.g., moving downwardly through the injection valve 16) causes the electronic circuit 42 to increment a counter and experiencing a predetermined magnetic signal from a magnetic device 38 flowing in the up-hole direction (e.g., moving upwardly through the injection valve 16) causes the electronic circuit 42 to decrement a counter. Conversely, in an embodiment, the DMSAA 100 may be configured such that experiencing a magnetic signal from a magnetic device 38 flowing in the down-hole direction causes the electronic circuit 42 to decrement a counter and experiencing a magnetic signal from a magnetic device 38 flowing in the up-hole direction causes the electronic circuit 42 to increment a counter. Additionally or, in an embodiment the DMSAA 100 may be configured such that experiencing a magnetic signal from a magnetic device 38 flowing in the down-hole direction causes the electronic circuit 42 to increment a counter and experiencing a predetermined magnetic signal from a magnetic device 38 flowing in the up-hole direction causes the electronic circuit 42 to decrement a counter in some circumstances (e.g., prior to actuation of the injection valve 16) and such that experiencing a magnetic signal from a magnetic device 38 flowing in the down-hole direction causes the electronic circuit 42 to decrement a counter and experiencing a magnetic signal from a magnetic device 38 flowing in the up-hole direction causes the electronic circuit 42 to increment a counter in another circumstance (e.g., following actuation of the injection valve 16).

In an embodiment, the electronic circuit 42 may be further configured to output a response (e.g., an electrical voltage or current signal) to the actuator 50 in response to a predetermined quantity of magnetic signals determined to have been received from a magnetic device traveling in a given direction (e.g., upon the counter reaching a given "count" or value, as disclosed herein). For example, in an embodiment, the electronic circuit 42 may be configured to transition an output from a low voltage signal (e.g., about 0 volts (V)) to a high voltage signal (e.g., about 5 V) in response to experiencing the predetermined number (e.g., in accordance with a counter "count" or value) of magnetic signals determined to have been received from a magnetic device traveling in a given direction. In an alternative embodiment, the electronic circuit 42 may be configured to transition an output from a high voltage signal (e.g., about 5 V) to a low voltage signal (e.g., about 0 V) in response to experiencing the predetermined number of magnetic signals determined to have been received from a magnetic device traveling in a given direction.

Additionally, in an embodiment, the electronic circuit 42 may be configured to operate in either a low-power consumption or "sleep" mode or, alternatively, in an operational or active mode. The electronic circuit 42 may be configured to enter the active mode (e.g., to "wake") in response to a predetermined quantity of magnetic signals determined to have been received from a magnetic device traveling in a given direction (e.g., one or more downwardly-moving signals). Additionally or alternatively, the electronic circuit 42 may be configured to enter the low-power consumption mode (e.g., to "sleep"), for example for a predetermined duration or until again caused to "wake," in response to a predetermined quantity of magnetic signals determined to have been received from a magnetic device traveling in a given direction (e.g., one or more upwardly-moving signaling members). This method can help prevent extraneous magnetic fields from being misidentified as magnetic signals.

In an embodiment, the electronic circuit 42 may be supplied with electrical power via a power source. For example, in an embodiment, the injection valve 16 may further comprise an on-board battery, a power generation device, or combinations thereof. In such an embodiment, the power source and/or power generation device may supply power to the electronic circuit 42, to the magnetic sensor 40, to the actuator 50, or combination thereof, for example, for the purpose of operating the electronic circuit 42, to the magnetic sensor 40, to the actuator 50, or combinations thereof. In an embodiment, such a power generation device may comprise a generator, such as a turbo-generator configured to convert fluid movement into electrical power; alternatively, a thermoelectric generator, which may be configured to convert differences in temperature into electrical power. In such embodiments, such a power generation device may be carried with, attached, incorporated within or otherwise suitable coupled to the well tool and/or a component thereof. Suitable power generation devices, such as a turbo-generator and a thermoelectric generator are disclosed in U.S. Pat. No. 8,162,050 to Roddy, et al., which is incorporated herein by reference in its entirety. An example of a power source and/or a power generation device is a Galvanic Cell. In an embodiment, the power source and/or power generation device may be sufficient to power the electronic circuit 42, to the magnetic sensor 40, to the actuator 50, or combinations thereof. For example, the power source and/or power generation device may supply power in the range of from about 0.5 watts to about 10 watts, alternatively, from about 0.5 watts to about 1.0 watt.

One or more embodiments of an DMSAA (e.g., such as DMSAA 100), a well tool (e.g., such as the injection valve 16) comprising such a DMSAA 100, and/or a wellbore servicing system comprising a well tool (e.g., such as the injection valve 16) comprising such a DMSAA 100 having been disclosed, one or more embodiments of a wellbore servicing method employing such an injection valve 16, such a DMSAA 100, and/or such a system are also disclosed herein. In an embodiment, a wellbore servicing method may generally comprise the steps of positioning a tubular string (e.g., such as tubular string 12) having an injection valve 16 comprising a DMSAA 100 incorporated therein within a wellbore (e.g., such as wellbore 14), introducing a magnetic device 38 within the injection valve 16, and transitioning the injection valve 16 to allow fluid communication between the flow passage 36 of the injection valve 16 and the exterior of the injection valve 16 in recognition of a predetermined number of magnetic signals from signaling members moving in a particular direction.

As will be disclosed herein, the DMSAA 100 may control fluid communication through the tubular 12 and/or the injection valve 16 during the wellbore servicing operation. For example, as will be disclosed herein, during the step of positioning the tubular 12 within the wellbore 14, the DMSAA 100 may be configured to disallow fluid communication between the flow passage 36 of the injection valve 16 and the wellbore 14, for example, via not actuating the actuator 50 and thereby causing a sleeve (e.g., the sleeve 32) to be retained in the first position with respect to the housing 30, as will be disclosed herein. Also, for example, during the step of transitioning the injection valve 16 so as to allow fluid communication between the flow passage 36 of the injection valve 16 and the exterior of the injection valve 16 (e.g., upon recognition of a predetermined number of magnetic signals from signaling members moving in a particular direction) the DMSAA 100 may be configured to allow fluid communication between the flow passage 36 of the injection valve 16 and the exterior of the injection valve 16, for example, via actuating the actuator 50 thereby transitioning the sleeve 32 to the second position with respect to the housing 30, as will be disclosed herein.

In an embodiment, positioning the tubular 12 having an injection valve 16 comprising a DMSAA 100 incorporated therein within a wellbore 14 may comprise forming and/or assembling components of the tubular 12, for example, as the tubular 12 is run into the wellbore 14. For example, referring to FIG. 1, a plurality of injection valves (e.g., injection valves 16*a*-16*e*), each comprising a DMSAA 100, are incorporated within the tubular 12 via a suitable adapter as would be appreciated by one of ordinary skill in the art upon viewing this disclosure.

In an embodiment, the tubular 12 and/or the injection valves 16*a*-16*e* may be run into the wellbore 14 to a desired depth and may be positioned proximate to one or more desired subterranean formation zones (e.g., zones 22*a*-22*d*). In an embodiment, the tubular 12 may be run into the wellbore 14 with the injection valves 16*a*-16*e* configured in the first configuration, for example, with the sleeve 32 in the first position with respect to the housing 30, as disclosed herein. In such an embodiment, with the injection valves 16*a*-16*e* in the first configuration, each valve will prohibit fluid communication between the flow passage 36 of the injection valve 16 and the exterior of the injection valve 16 (e.g., the wellbore 14). For example, as shown in FIGS. 15A-15B, when the injection valve 16 is configured in the first configuration fluid communication may be prohibited between the flow passage 36 of the injection valve 16 and the exterior of the injection valve 16 via the openings 28.

In an embodiment, one or more magnetic devices 38 may be communicated through the flow passage 36 of the injection valve 16 (e.g., via the axial flowbore of the wellbore servicing system 10) and may be pumped down-hole to magnetically actuate and, optionally, engage one or more injection valves 16*a*-16*e*. For example, in an embodiment, a magnetic device 38 may be pumped into the axial flowbore of the wellbore servicing system 10, for example, along with a fluid communicated via one or more pumps generally located at the earth's surface.

In an embodiment, the magnetic device 38 may be configured to emit and/or to transmit a magnetic signal while traversing the axial flowbore of the wellbore servicing system 10. Additionally, in an embodiment the magnetic device 38 may transmit a magnetic signal which may be particularly associated with one or more injection valves (e.g., a signal effective to actuate only certain valves). In such an embodiment, the magnetic device 38 may be configured to target and/or to provide selective actuation of one or more injection valves, thereby enabling fluid communication between the flow passage of the one or more injection valves and the exterior of the one or more injection valves. Alternatively, in an embodiment the magnetic device 38 may transmit a magnetic signal which is not uniquely associated with any one injection valve. For example, the magnetic device 38 may transmit a magnetic signal which may be associated with multiple injection valves (e.g., all valves).

In an embodiment, transitioning the injection valve 16 so as to allow fluid communication between the flow passage 36 of the injection valve 16 and the exterior of the injection valve 16 in recognition of a predetermined number of magnetic signals from signaling members moving in a particular direction may comprise transitioning the injection valve 16 from the first configuration to the second configuration, for example, via transitioning the sleeve 32 from the first position to the second position with respect to the housing 30, as shown in FIGS. 16A-16B. In an embodiment, the injection valve 16 and/or the DMSAA 100 may experience and be responsive to a predetermined number of magnetic signals from signaling members moving in a particular direction, for example, as may be emitted upon communicating one or more magnetic devices 38 through the wellbore servicing system 10 (e.g., through the injection valves 16*a*-*e*).

In the embodiment of FIG. 18, a detailed explanation of a magnetic device 38 counting method 100 is provided. In an embodiment, following introduction of a magnetic device 38 (e.g., a ball) into the flow passage 36 of the injection valve 16, the magnetic sensors 40 (e.g., the first magnetic sensor 40*a* and the second magnetic sensor 40*b*) may monitor the flow passage 36 of the injection valve 16 for the magnetic device 38 (e.g., a ball) and/or a magnetic signal at 102.

In an embodiment, the flow direction of the magnetic device 38 may be determined by the magnetic sensors 40 (e.g., the first magnetic sensor 40*a* and the second magnetic sensor 40*b*) and/or the electronic circuit 42 at 104, as disclosed herein.

In an embodiment, in response to experiencing a magnetic signal and determining the magnetic device 38 is flowing in a down-hole direction, the DMSAA 100 may increment a counter (e.g., a digital counter, a program variable stored in a memory device, etc.) at 106. Conversely, in response to experiencing a magnetic signal and determining the magnetic device 38 is flowing in an up-hole direction, the DMSAA 100 may decrement a counter (e.g., a digital counter, a program variable stored in a memory device, etc.) at 108. In an embodiment, following incrementing or decrementing a counter, the DMSAA 100 may continue to monitor the flow passage 36 of the injection valve 16 for the magnetic device 38 (e.g., a ball) and/or a predetermined magnetic signal at 102.

In an embodiment, upon recognition of a predetermined number of magnetic signals (e.g., predetermined magnetic signals) from signaling members moving in a particular direction, the DMSAA 100 may actuate (e.g., via outputting an actuation electrical signal) the actuator 50, thereby causing the sleeve 32 to move relative to the housing 30 and thereby transitioning the sleeve 32 from the first position to the second position with respect to the housing 30.

In an embodiment, for example, in the embodiment of FIG. 1, the valves 16 may be configured to actuate (alternatively, to output any other suitable response) upon recognition of a predetermined number of magnetic signals from signaling members moving in a particular direction. For example, referring to FIG. 1, while a first valve (e.g., valve 16*e*) may be configured to actuate after experiencing only one magnetic signal from a magnetic device traveling downward through the tubular 12, relatively more uphole valves (e.g., valves 16*a-d*) may, upon experiencing the same magnetic signal, increment a counter without actuating. Also, in such an embodiment, additional valves (e.g., valves 16*a-d*) may be configured to actuate upon experiencing two, three, four, five, six, seven, eight, nine, ten, or more magnetic signals.

In an embodiment, when one or more injection valves 16 are configured for the communication of a servicing fluid, as disclosed herein, a suitable wellbore servicing fluid may be communicated to the subterranean formation zone associated with that valve. Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation and/or a zone thereof.

In an embodiment, when a desired amount of the servicing fluid has been communicated via a first valve 16, an operator may cease the communication. Optionally, the treated zone may be isolated, for example, via a mechanical plug, sand plug, or the like, or by a ball or plug. The process of transitioning a given valve from the first configuration to the second configuration (e.g., via the introduction of various magnetic devices) and communicating a servicing through the open valve(s) 16 may be repeated with respect to one or more of the valves, and the formation zones associated therewith.

Additionally, in an embodiment one or more magnetic devices may be removed from the tubular. In such an embodiment where a magnetic device 38 is removed from the tubular (e.g., via reverse circulation), it may be necessary to reintroduce such magnetic devices 38, for example, in order to reestablish the appropriate "count" associated with the counter for each valve 16 (e.g., because the counter may be decremented upon removal of such magnetic devices). Additionally or alternatively, in an embodiment a valve 16 may be configured to be disabled (e.g., for a predetermined time period) upon receipt of a particular magnetic signal (e.g., as disclosed herein), for example, such that one or more magnetic device may be removed without causing the counter of one or more valves 16 to be decremented as disclosed herein.

In an embodiment, a well tool such as the injection valve 16, a wellbore servicing system such as wellbore servicing system 10 comprising an injection valve 16 comprising a DMSAA, such as DMSAA 100, a wellbore servicing method employing such a wellbore servicing system 10 and/or such an injection valve 16 comprising a DMSAA 100, or combinations thereof may be advantageously employed in the performance of a wellbore servicing operation. In an embodiment, as previously disclosed, a DMSAA allows an operator to selectively actuate one or more injection valves, for example, via introducing a predetermined quantity of magnetic devices emitting a magnetic signal (which may or may not be particularly associated with the one or more injection valves). As such, a DMSAA may be employed to provide improved performance during a wellbore operation, for example, via allowing multiple injection valves to actuate substantially simultaneously and/or to be selectively actuated. Additionally, conventional well tools may be prone to false positive readings, for example, due to potential bidirectional flow of a magnetic device through the flow passage of a conventional tool. In an embodiment, a DMSAA may reduce accidental actuation of an injection valve, for example, as a result of a false positive sensing of a magnetic device and thereby provides improved reliability of the wellbore servicing system and/or well tool. For example, in an embodiment, a magnetic device will either increment or decrement a counter within the DMSAA 100 to distinguish between multiple magnetic devices traversing unidirectionally (e.g., in a down-hole direction) within the flow passage of the well tool and a single magnetic device moving bidirectionally (e.g., in a down-hole direction and then in an up-hole direction) within the flow passage of the well tool.

It should be understood that the various embodiments previously described may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

Additional Disclosure

The following are nonlimiting, specific embodiments in accordance with the present disclosure:

A first embodiment, which is a wellbore servicing system comprising:

a tubular string disposed within a wellbore; and a first well tool incorporated with the tubular string and comprising:

a housing comprising one or more ports and generally defining a flow passage;

an actuator disposed within the housing;

a dual magnetic sensor actuation assembly (DMSAA) disposed within the housing and in signal communication with the actuator and comprising a first magnetic sensor positioned up-hole relative to a second magnetic sensor; and an electronic circuit comprising a counter; and wherein, the DMSAA is configured to detect a magnetic signal and to determine the direction of movement of the magnetic device emitting the magnetic signal; and a sleeve slidably positioned within the housing and transitional from a first position to a second position;

wherein, when the sleeve is in the first position, the sleeve is configured to prevent a route of fluid communication via the one or more ports of the housing and, when the sleeve is in the second position, the sleeve is configured to allow fluid communication via the one or more ports of the housing, wherein, the sleeve is allowed to transition from the first position to the second position upon actuation of the actuator, and wherein the actuator actuated upon recognition of a predetermined quantity of magnetic signals traveling in a particular flow direction.

A second embodiment, which is the wellbore servicing system of the first embodiment, wherein the DMSAA is configured to determine the direction of movement of the magnetic device emitting the magnetic signal based upon a first signal received from the first magnetic sensor and a second signal received from the second sensor.

A third embodiment, which is the wellbore servicing system of the second embodiment, wherein, upon receipt of the first signal prior to receipt of the second signal, the DMSAA determines that the movement of the magnetic device is downward, and wherein, upon receipt of the second signal prior to receipt of the first signal, the DMSAA determines that the movement of the magnetic device is upward.

A fourth embodiment, which is the wellbore servicing system of the third embodiment, wherein the DMSAA is configured to increment the counter in response to a determination that the movement of the magnetic device is downward, and wherein the DMSAA is configured to decrement the counter in response to a determination that the movement of the magnetic device downward.

A fifth embodiment, which is the wellbore servicing system of the fourth embodiment, wherein the DMSAA sends an actuating signal upon the counter reaching the predetermined quantity.

A sixth embodiment, which is the wellbore servicing system of one of the first through the fifth embodiments, wherein the magnetic signal comprises a generic magnetic signal.

A seventh embodiment, which is the wellbore servicing system of the sixth embodiment, wherein the generic magnetic signal is not particularly associated with one or more well tools including the first well tool.

An eighth embodiment, which is the wellbore servicing system of one of the first through the fifth embodiments, wherein the magnetic signal comprises a predetermined magnetic signal.

A ninth embodiment, which is the wellbore servicing system of one of the first through the fifth embodiments, wherein the predetermined magnetic signal is particularly associated with one or more well tools including the first well tool.

A tenth embodiment, which is the wellbore servicing system of the ninth embodiment, wherein the DMSAA is configured to recognized the predetermined magnetic signal.

An eleventh embodiment, which is the wellbore servicing system of the third embodiment, wherein the DMSAA is configured to enter an active mode, to enter a low-power consumption mode, or combinations thereof based upon the direction of movement of the magnetic device.

A twelfth embodiment, which is the wellbore servicing system of the eleventh embodiment, wherein the DMSAA is configured to enter the active mode in response to a determination that the movement of the magnetic device is downward.

A thirteenth embodiment, which is the wellbore servicing system of the eleventh embodiment, wherein the DMSAA is configured to enter the low-power consumption mode in response to a determination that the movement of the magnetic device upward.

A fourteenth embodiment, which is a wellbore servicing tool comprising:

a housing comprising one or more ports and generally defining a flow passage;

a first magnetic sensor and a second magnetic sensor disposed within the housing, wherein the first magnetic sensor is positioned up-hole of the second magnetic sensor;

an electronic circuit coupled to the first magnetic sensor and the second magnetic sensor; and a memory coupled to the electronic circuit, wherein the memory comprises instructions that cause the electronic circuit to:

detect a magnetic device within the housing;

determine the flow direction of the magnetic device through the housing; and adjust a counter in response to the detection of the magnetic device and the determination of the flow direction of the magnetic device through the housing.

A fifteenth embodiment, which is the wellbore servicing tool of the fourteenth embodiment, wherein detecting one or more magnetic devices comprises the first magnetic sensor or the second magnetic sensor experiencing the one or more magnetic signals.

A sixteenth embodiment, which is the wellbore servicing method of one of the fourteenth through the fifteenth embodiments, wherein determining the flow direction of the magnetic device is based on the order of which the first magnetic sensor and the second magnetic sensor detect the magnetic device.

A seventeenth embodiment, which is the wellbore servicing method of the sixteenth embodiment, wherein a magnetic device traveling in a first flow direction is detected by the first magnetic sensor followed by the second magnetic sensor and a magnetic device traveling in a second flow direction is detected by the second magnetic sensor followed by the first magnetic sensor.

An eighteenth embodiment, which is the wellbore servicing method of the seventeenth embodiment, wherein adjusting the counter comprises incrementing the counter in response to the magnetic device traveling in the first flow direction and decrementing the counter in response to the magnetic device traveling in the second flow direction.

A nineteenth embodiment, which is the wellbore servicing method of the seventeenth embodiment, wherein adjusting the counter comprises incrementing the counter in response to the magnetic device traveling in the second flow direction and decrementing the magnetic device counter in response to the magnetic device traveling in the first flow direction.

A twentieth embodiment, which is a wellbore servicing method comprising:

positioning a tubular string comprising a well tool comprising a dual magnetic sensor actuation assembly (DMSAA) within a wellbore, wherein the well tool is configured to disallow a route of fluid communication between the exterior of the well tool and an axial flowbore of the well tool;

introducing one or more magnetic devices to the axial flowbore of the well tool, wherein each of the magnetic devices transmits a magnetic signal;

detecting the one or more magnetic devices;

determining the flow direction of the one or more magnetic devices;

adjusting a magnetic device counter in response to the detection and the flow direction of the magnetic devices;

actuating the well tool in recognition of a predetermined quantity of predetermined magnetic signals traveling in a particular flow direction, wherein the well tool is reconfigured to allow a route of fluid communication between the exterior of the well tool and the axial flowbore of the well tool.

A twenty-first embodiment, which is the wellbore servicing method of the twentieth embodiment, wherein the DMSAA comprises a first magnetic sensor positioned up-hole of a second magnetic sensor.

A twenty-second embodiment, which is the wellbore servicing method of one of the twentieth through the twenty-first embodiments, wherein detecting one or more magnetic devices comprises the first magnetic sensor or the second magnetic sensor experiencing the one or more magnetic signal.

A twenty-third embodiment, which is the wellbore servicing method of the twenty-second embodiment, wherein determining the flow direction of the magnetic device is based on the order of which the first magnetic sensor and the second magnetic sensor detect the magnetic device.

A twenty-fourth embodiment, which is the wellbore servicing method of the twenty-third embodiment, wherein a magnetic device traveling in a first flow direction is detected by the first magnetic sensor followed by the second magnetic sensor and a magnetic device traveling in a second flow direction is detected by the second magnetic sensor followed by the first magnetic sensor.

A twenty-fifth embodiment, which is the wellbore servicing method of the twenty-fourth embodiment, wherein adjusting the magnetic device counter comprising incrementing the magnetic device counter in response to the magnetic device traveling in the first flow direction and decrementing the magnetic device counter in response to the magnetic device traveling in the second flow direction.

A twenty-sixth embodiment, which is the wellbore servicing method of the twenty-fourth embodiment, wherein adjusting the magnetic device counter comprising incrementing the magnetic device counter in response to the magnetic device traveling in the second flow direction and decrementing the magnetic device counter in response to the magnetic device traveling in the first flow direction.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing system comprising:

a tubular string disposed within a wellbore; and a first well tool incorporated with the tubular string and comprising:

a housing comprising one or more ports and generally defining a flow passage;

an actuator disposed within the housing;

a dual magnetic sensor actuation assembly (DMSAA) disposed within the housing and in signal communication with the actuator and comprising a first magnetic sensor positioned up-hole relative to a second magnetic sensor; and an electronic circuit comprising a counter; and wherein, the DMSAA is configured to detect a magnetic signal and to determine the direction of movement of a magnetic device emitting the magnetic signal; and a sleeve slidably positioned within the housing and transitional from a first position to a second position;

wherein, when the sleeve is in the first position, the sleeve is configured to prevent a route of fluid communication via the one or more ports of the housing and, when the sleeve is in the second position, the sleeve is configured to allow fluid communication via the one or more ports of the housing, wherein, the sleeve is allowed to transition from the first position to the second position upon actuation of the actuator, and wherein the actuator actuated upon recognition of a predetermined quantity of magnetic signals traveling in a particular flow direction.

2. The wellbore servicing system of claim 1, wherein the DMSAA is configured to determine the direction of movement of the magnetic device emitting the magnetic signal based upon a first signal received from the first magnetic sensor and a second signal received from the second sensor.

3. The wellbore servicing system of claim 2, wherein, upon receipt of the first signal prior to receipt of the second signal, the DMSAA determines that the movement of the magnetic device is downward, and wherein, upon receipt of the second signal prior to receipt of the first signal, the DMSAA determines that the movement of the magnetic device is upward.

4. The wellbore servicing system of claim 3, wherein the DMSAA is configured to increment the counter in response to a determination that the movement of the magnetic device is downward, and wherein the DMSAA is configured to decrement the counter in response to a determination that the movement of the magnetic device is downward.

5. The wellbore servicing system of claim 4, wherein the DMSAA sends an actuating signal upon the counter reaching the predetermined quantity.

6. The wellbore servicing system of claim 3, wherein the DMSAA is configured to enter an active mode, to enter a low-power consumption mode, or combinations thereof based upon the direction of movement of the magnetic device.

7. The wellbore servicing system of claim 6, wherein the DMSAA is configured to enter the active mode in response to a determination that the movement of the magnetic device is downward.

8. The wellbore servicing system of claim 6, wherein the DMSAA is configured to enter the low-power consumption mode in response to a determination that the movement of the magnetic device is upward.

9. The wellbore servicing system of claim 1, wherein the magnetic signal comprises a generic magnetic signal.

10. The wellbore servicing system of claim 1, wherein the magnetic signal comprises a predetermined magnetic signal.

11. The wellbore servicing system of claim 1, wherein the predetermined magnetic signal is particularly associated with one or more well tools including the first well tool.

12. The wellbore servicing system of claim 11, wherein the DMSAA is configured to recognize the predetermined magnetic signal.

13. A wellbore servicing tool comprising:

a housing comprising one or more ports and generally defining a flow passage;

a first magnetic sensor and a second magnetic sensor disposed within the housing, wherein the first magnetic sensor is positioned up-hole of the second magnetic sensor;

an electronic circuit coupled to the first magnetic sensor and the second magnetic sensor; and a memory coupled to the electronic circuit, wherein the memory comprises instructions that cause the electronic circuit to:

detect a magnetic device within the housing;

determine the flow direction of the magnetic device through the housing; and adjust a counter in response to the detection of the magnetic device and the determination of the flow direction of the magnetic device through the housing.

14. The wellbore servicing tool of claim 13, wherein detecting one or more magnetic devices comprises the first magnetic sensor or the second magnetic sensor experiencing the one or more magnetic signals.

15. The wellbore servicing method of claim 13, wherein determining the flow direction of the magnetic device is based on the order of which the first magnetic sensor and the second magnetic sensor detect the magnetic device.

16. The wellbore servicing method of claim 15, wherein a magnetic device traveling in a first flow direction is detected by the first magnetic sensor followed by the second magnetic sensor and a magnetic device traveling in a second flow direction is detected by the second magnetic sensor followed by the first magnetic sensor.

17. A wellbore servicing method comprising:

positioning a tubular string comprising a well tool comprising a dual magnetic sensor actuation assembly (DMSAA) within a wellbore, wherein the well tool is configured to disallow a route of fluid communication between the exterior of the well tool and an axial flowbore of the well tool;

introducing one or more magnetic devices to the axial flowbore of the well tool, wherein each of the magnetic devices transmits a magnetic signal;

detecting the one or more magnetic devices;

determining the flow direction of the one or more magnetic devices;

adjusting a magnetic device counter in response to the detection and the flow direction of the magnetic devices;

actuating the well tool in recognition of a predetermined quantity of predetermined magnetic signals traveling in a particular flow direction, wherein the well tool is reconfigured to allow a route of fluid communication between the exterior of the well tool and the axial flowbore of the well tool.

18. The wellbore servicing method of claim 17, wherein the DMSAA comprises a first magnetic sensor positioned up-hole of a second magnetic sensor.

19. The wellbore servicing method of claim 17, wherein detecting one or more magnetic devices comprises the first magnetic sensor or the second magnetic sensor experiencing the one or more magnetic signal.

20. The wellbore servicing method of claim 19, wherein determining the flow direction of the magnetic device is based on the order of which the first magnetic sensor and the second magnetic sensor detect the magnetic device.

21. The wellbore servicing method of claim 20, wherein a magnetic device traveling in a first flow direction is detected by the first magnetic sensor followed by the second magnetic sensor and a magnetic device traveling in a second flow direction is detected by the second magnetic sensor followed by the first magnetic sensor.

* * * * *